US006158590A

United States Patent [19]

Fujikawa et al.

[11] Patent Number: 6,158,590

[45] Date of Patent: Dec. 12, 2000

[54] SEALED BAG AND CONTAINER FOR ACCOMMODATING ELECTRONIC DEVICE, AND METHOD FOR FACILITATING STORING AND TRANSPORTING ELECTRONIC DEVICE USING SUCH SEALED BAG AND CONTAINER

[75] Inventors: Hisashi Fujikawa, Ayama-gun; Youki Yoneda, Sakai, both of Japan

[73] Assignee: Sharp Kabushiki Kaisha, Osaka, Japan

[21] Appl. No.: 09/047,640

[22] Filed: Mar. 25, 1998

Related U.S. Application Data

[62] Division of application No. 08/671,636, Jun. 27, 1996, Pat. No. 5,784,860.

[30] Foreign Application Priority Data

| | | | |
|---|---|---|---|
| Jun. 29, 1995 | [JP] | Japan | 7-163990 |
| Mar. 15, 1996 | [JP] | Japan | 8-059854 |
| May 21, 1996 | [JP] | Japan | 8-125994 |

[51] Int. Cl.[7] ..... B65D 85/86

[52] U.S. Cl. ..... 206/720; 206/721

[58] Field of Search ..... 206/485, 521, 206/523, 706, 719–725

[56] References Cited

U.S. PATENT DOCUMENTS

| | | | |
|---|---|---|---|
| 2,954,140 | 9/1960 | Sutherland et al. | 206/719 |
| 4,154,344 | 5/1979 | Yenni, Jr. et al. | 206/720 |
| 4,699,830 | 10/1987 | White | 206/720 |
| 4,756,414 | 7/1988 | Mott | 206/720 |
| 4,798,290 | 1/1989 | Bradford | 206/721 |
| 4,906,494 | 3/1990 | Babinec et al. | 206/720 |
| 4,966,280 | 10/1990 | Bradford | 206/721 |
| 5,043,195 | 8/1991 | Skrivseth | 206/720 |
| 5,091,229 | 2/1992 | Golike et al. | 206/720 |
| 5,131,543 | 7/1992 | Stephens | 206/523 |
| 5,217,767 | 6/1993 | Gutman et al. | 206/720 |
| 5,249,685 | 10/1993 | Stephens | 206/719 |
| 5,287,962 | 2/1994 | Nomi et al. | 206/524.8 |
| 5,458,237 | 10/1995 | Kataoka | 206/723 |

FOREIGN PATENT DOCUMENTS

| | | |
|---|---|---|
| 53-88953 | 8/1978 | Japan . |

*Primary Examiner*—Jim Foster
*Attorney, Agent, or Firm*—David G. Conlin; George W. Neuner

[57] ABSTRACT

A sealed bag for vacuum-packing an electronic device in the state of being evacuated and partially thermally fused at an opening thereof includes a multi-layer film including; a first anti-static layer; a thin metal layer; an insulative layer; and a second anti-static layer. A container includes a case for accommodating at least two such sealed bags. The case is provided with a charge protective layer on an inner surface thereof; a housing for accommodating at least two cases; and a master carton for accommodating at least one housing.

13 Claims, 19 Drawing Sheets

SEALED BAG AND CONTAINER FOR ACCOMMODATING ELECTRONIC DEVICE, AND METHOD FOR FACILITATING STORING AND TRANSPORTING ELECTRONIC DEVICE USING SUCH SEALED BAG AND CONTAINER

This application is a divisional of U.S. application Ser. No. 08/671,636, filed Jun. 27, 1996, now U.S. Pat. No. 5,784,860.

BACKGROUND OF THE INVENTION

1. Field of the Invention

The present invention relates to a bag and a container for accommodating, storing and transporting electronic devices. The present invention also relates to a method for facilitating storing and a method for facilitating transporting the electronic devices using such a bag and container.

2. Description of the Related Art

It is known that electronic devices such as liquid crystal panels can be damaged by electrostatic charges relatively easily. Various devices and methods have been developed for protecting such electronic devices against electrostatic charge while being accommodated, stored and transported.

For protecting liquid crystal panels, the following devices and method have conventionally been developed: Liquid crystal panels are each put into a plastic bag formed of a charge protective (conductive) material. A "charge protective material" is defined as a material which does not accumulate or generate electrostatic charge. Such a plastic bag is formed of, for example, material containing polyethylene (PE) and an anion surfactant mixed therewith. A plurality of such plastic bags each including a liquid crystal panel are accommodated in a plastic foam container. The container is formed of a material containing plastic material such as styrol and a charge protective material kneaded therein. In the container, a urethane sponge containing pure water is also accommodated together with the plastic bags. The container is air-tight and thus maintains relative humidity therein at about 95%. Each of the plastic bags is not sealed but is simply folded at the mouth thereof, and humidity within the plastic bags is also relatively high. Since steam has an effect of removing electric charge, generation of electrostatic charge in the container can be prohibited.

The container has grooves in inner surfaces thereof. Each of the plastic bags is partially inserted into the grooves to be secured. The container also has a receptacle in an outer surface thereof for securing a recording medium such as a floppy disk which has stored information such as the production record and the like of the plurality of liquid crystal panels accommodated in the container.

Inside manufacturing plants, the liquid crystal panels are often stored on racks formed of conductive material such as aluminum, namely, material which can shield and prevent the liquid crystal panels from being electrostatically charged.

However, the above-described conventional technology exhibit the following problems:

(1) When the ambient temperature excessively increases during transportation or storage, an ultraviolet (UV)-curable resin which seals the openings of the liquid crystal panel provided for injection of liquid crystal material is delaminated, or the chrome wires in the liquid crystal panel begin to corrode causing leakage between the wires. These phenomena are considered to occur because the UV-curable resin at the openings of the liquid crystal panel is deteriorated by the excessively high temperature and humidity and water invading the liquid crystal panel through the openings.

(2) The openings are physically damaged as a result of friction with the inner surface of the container. The openings, which protrude from the panel, are relatively easily subjected to stress when the liquid crystal panel in the plastic bag is inserted into the grooves of the container. Since the liquid crystal panel is secured in the grooves, external force, vibration and impact applied to the container directly act on the liquid crystal panel as stress and can cause physical damage.

(3) The plastic foam used for the container generates environmental problems when being disposed of. Methods for recycling plastic foam, reducing the quantity, and disposing of plastic foam at reasonable cost should be developed in order to solve the environmental problems.

(4) Since the container is formed by molding plastic foam, molds need to be produced in accordance with various sizes of the liquid crystal panels, which increases cost.

SUMMARY OF THE INVENTION

According to one aspect of the invention, a sealed bag for vacuum-packing an electronic device in the state of being evacuated and partially thermally fused at an opening thereof includes a multi-layer film including a first anti-static layer; a thin metal layer; an insulative layer; and a second anti-static layer.

In one embodiment of the invention, the multi-layer film is a four-layer film including the first anti-static layer, the thin metal layer, the insulative layer, and the second anti-static layer.

In another embodiment of the invention, the first anti-static layer and the second anti-static layer each have a surface resistance of $10^5$ Ω to $10^9$ Ω inclusive.

According to another aspect of the invention, a container includes a case for accommodating at least two such sealed bags, the case being provided with a charge protective layer on an inner surface thereof; a housing for accommodating at least two cases; and a master carton for accommodating at least one housing.

In one embodiment of the invention, the case is formed of a cardboard and has at least one tab for fitting the case to the housing.

In another embodiment of the invention, the housing is formed of a cardboard and has a groove for receiving the at least one tab of the case.

In still another embodiment of the invention, the case is supported by the tab inserted into the groove, and both an inner area of the case to be in contact with the sealed bag and the tab are sized based on the size of the sealed bag.

In yet another embodiment of the invention, the master carton is provided with a charge protective layer on an inner surface thereof for direct electrical connection with the second anti-static layer of the sealed bag.

In yet another embodiment of the invention, the master carton is provided with a charge protective layer on an inner surface thereof for indirect electrical connection with the second anti-static layer of the sealed bag.

According to still another aspect of the invention, a method for facilitating storing an electronic device includes the steps of inserting the electronic device into a sealed bag formed of a multi-layer film including a first anti-static layer, a thin metal layer, an insulative layer, and a second anti-static layer; and evacuating the sealed bag and thermally fusing an opening of the sealed bag to vacuum-pack the electronic device in the sealed bag.

According to yet another aspect of the invention, a method for facilitating storing an electronic device includes the steps of accommodating two sealed bags in a case provided with a charge protective layer on an inner surface thereof; accommodating the case in a housing; and accommodating the housing in a master carton. The two sealed bags are each formed of a multi-layer film including a first anti-static layer, a thin metal layer, an insulative layer, and a second anti-static layer.

According to yet another aspect of the invention, a method for facilitating transporting an electronic device includes the steps of inserting the electronic device into a sealed bag formed of a multi-layer film including a first anti-static layer, a thin metal layer, an insulative layer, and a second anti-static layer; and evacuating the sealed bag and thermally fusing an opening of the sealed bag to vacuum-pack the electronic device in the sealed bag.

According to yet another aspect of the invention, a method for facilitating transporting an electronic device includes the steps of accommodating two sealed bags in a case provided with a charge protective layer on an inner surface thereof; accommodating the case in a housing; and accommodating the housing in a master carton. The two sealed bags are each formed of a multi-layer film including a first anti-static layer, a thin metal layer, an insulative layer, and a second anti-static layer.

According to yet another aspect of the invention, a container includes a case formed of a sheet of paper which has an accommodating space for accommodating a plurality of electronic devices; and a housing for accommodating a plurality of cases arranged in a first direction, the housing being formed of a sheet of paper.

In one embodiment of the invention, the container further includes holders fit in recesses of the cases, the recesses being formed of cutouts of each case, each of the holder being formed of a sheet of paper.

In another embodiment of the invention, the plurality of cases each have two accommodation spaces aligned in the first direction, and also have two adjacent recesses aligned in a second direction perpendicular to the first direction, each recess extending in the first direction, each of the holders being fit in each recess.

In still another embodiment of the invention, the container further includes a partition formed of a sheet of paper and f it into the plurality of cases via slits of the cases formed in a third direction perpendicular to both of the first and second directions, the partition separating each of the two accommodation spaces of each case into two to define two accommodation spaces arranged in the second direction.

In yet another embodiment of the invention, each case has a tab on each of two side surfaces thereof, and the housing has a plurality of grooves extending in the third direction for receiving the tabs of the plurality of cases, and the plurality of cases are fit into the housing by the engagement of the tabs into the grooves.

In yet another embodiment of the invention, the two recesses each have two symmetrical first steps and a second step flanked by the first steps below the first steps, and each holder fits into the first steps of the corresponding recess.

In yet another embodiment of the invention, each holder has a bottom plate and a plurality of tongues arranged in the first direction and projecting from the bottom plate in the third direction, and the tongues are inserted between the plurality of cases arranged in the first direction when the holder is fit in the corresponding recess.

In yet another embodiment of the invention, the cases, the housing, the holders, and the partition are each formed of a cardboard.

In yet another embodiment of the invention, the cases are each provided with a charge protective layer on an inner surface thereof.

Due to the above-described structure according to the present invention, a sealed bag is formed of a material having a sufficiently high barrier property. After the electronic device is put in the sealed bag, the sealed bag is evacuated and sealed by thermally fusing the opening thereof. Even if ambient temperature or humidity raise during the storage or transportation, humidity within the sealed bag is maintained at a sufficiently low level, thus protecting the electronic device against moisture. Moreover, the sealed bag adheres to the electronic device and thus does not generate electrostatic charge by friction with the electronic device.

The sealed bag is formed of a material including an anti-static layer, a thin metal layer, an insulative layer, and another anti-static layer. The thin metal layer is inside the insulative layer, and these two layers are interposed between the two anti-static layers. Even if electrostatic charge is generated inside the sealed bag when the sealed bag is opened and the electronic device is frictionally removed or peeled off from the sealed bag, such electrostatic charge flows from the inner anti--static layer to the thin metal layer and diffused in these two layers. Therefore, generation of an excessively high voltage in a local area is prevented. Electrostatic charge which is generated outside the sealed bag is diffused in the outer anti-static layer, preventing an excessively high voltage from being generated locally outside the sealed bag. The insulative layer provided between the outer anti-static layer and the thin metal layer prevents outside electrostatic charge from reaching the inside of the sealed bag. The thin metal layer, which has an excessively low gas permeability, prevents invasion of humidity and air from outside and thus maintains the high degree of vacuum inside the sealed bag.

As is described above, the electronic device vacuum-packed in the sealed bag is protected against electrostatic charge and excessive humidity, and can be stored for a relative long period of time in satisfactory conditions.

According to a container of the present invention, at least two such sealed bags are accommodated in a case, and at least one such case is accommodated in a housing. The housing is further accommodated in a master carton. Due to such a structure, a great number of electronic devices can be stored for a relatively long period of time in satisfactory conditions.

The case i s provided with a layer formed of a charge protective material on a partial or the entire inner surface thereof. Accordingly, the case can protect the sealed bags and the electronic devices against external electrostatic charge and humidity. Thus, the electronic devices can be stored for a relatively long period of time without being damaged.

The case is formed relatively easily by folding a single sheet of cardboard without using any adhesive material. The case preferably has at least one tab along a periphery thereof which is used for guiding and securing the case in the housing. The size of the parts of the case which are to be in con tact with the sealed bag and the size of the tab are determined based on the size of the sealed bag. The size can be relatively easily changed by adjusting the positions and lengths of folding lines and the lines to be cut. Thus, various sized cases for various sized electronic devices can be formed from the same sized sheet of cardboard. Since the case is mainly supported by the housing via the tab, various sized cases containing various sized electronic devices can be accommodated in the same housing and master carton.

The housing is also formed relatively easily by folding a cardboard without using any adhesive material. The housing preferably has grooves to be engaged with the tabs. In the case where the housing has grooves for receiving the tabs of the cases, accommodation of the cases in the housing is facilitated. The grooves also maintain the distance between two adjacent cases.

In the case where each case has a space for accommodating four sealed bags, cost performance is improved.

In the case where the case has two symmetrical first steps and a second step flanked by the first steps below the first steps, the sealed bag can be more easily removed from the case.

In the case where the container includes only one housing, space is saved. Furthermore, the container can be assembled in a shorter period of time and more efficiently. The number of required elements is smaller, and the amount of cardboard can be reduced, thus reducing production cost.

Each element of the container is formed of a paper-based material, which can be recycled and is favorable from an environment conservation point of view. Such a material can be relatively easily disposed of after being or recycled. Since the same material is used for all the elements, the material is wasted less.

Thus, the invention described herein makes possible the advantages of providing a bag and a relatively easy-to-assemble container for accommodating, storing and transporting an electronic device while protecting the device against electrostatic charge and mechanical forces, and a method for facilitating storing and a method for transporting the facilitating electronic device using such a bag and container.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

EXAMPLE 1

Figure 3:
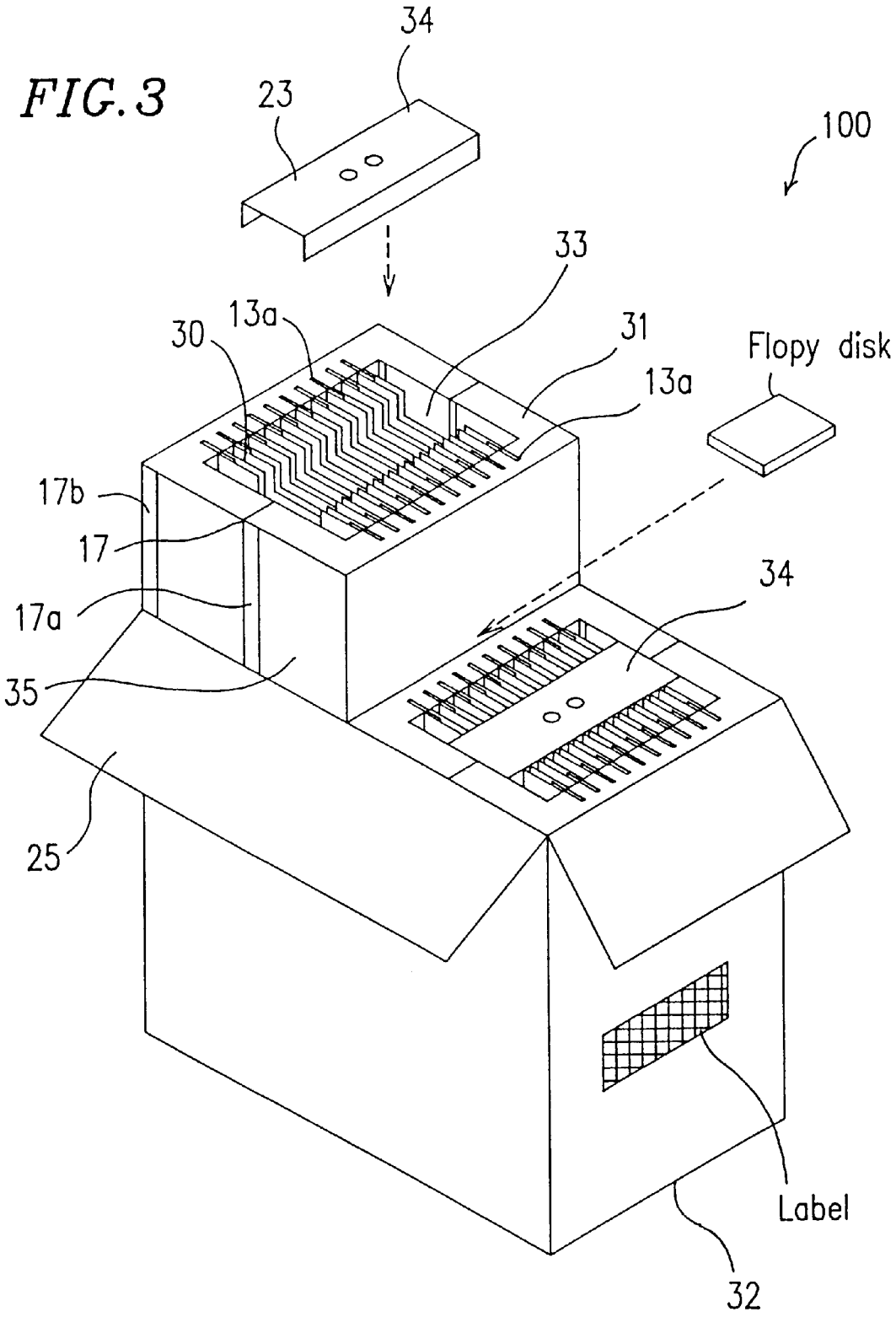
FIG. 3 is a partially exploded isometric view of a container in a first example according to the present invention for accommodating a plurality of sealed bags each of which vacuum-packs a liquid crystal panel.

FIG. 3 is a partially exploded isometric view of a container 100 for accommodating a liquid crystal panel in a first example according to the present invention.

As is shown in FIG. 3, the container 100 includes a master carton 32 for accommodating two housings 31. Each housing 31 can accommodate a plurality of cases 30. As is described later, each case 30 can accommodate two sealed bags 2 each containing a liquid crystal panel 1 (FIG. 1A).

The case 30 can accommodate any other number of sealed bags 2, the housing 31 can accommodate any other number of cases 30, and the master carton 32 can accommodate any other number of housings 31. Two or more of each element are preferably accommodated in order to make efficient use of the space.

Sealed Bag

Figure 1A:
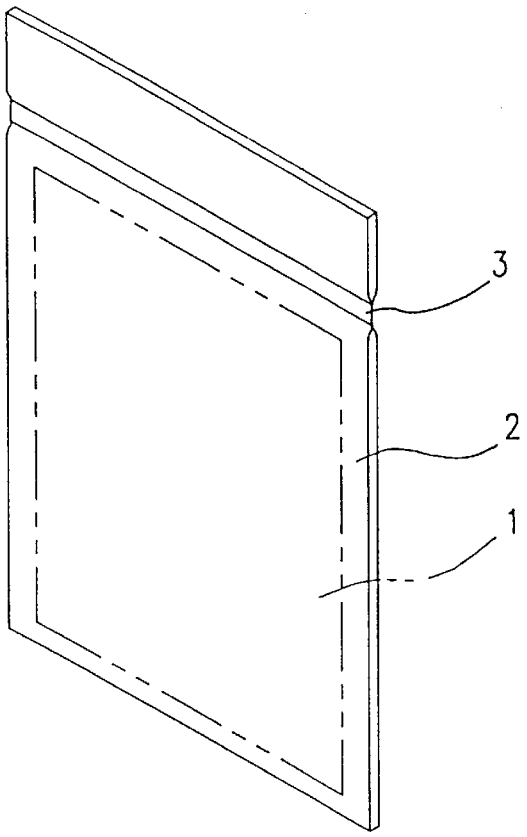
FIG. 1A is an isometric view of a sealed bag in the state of vacuum-packing a liquid crystal panel.
Figure 1B:
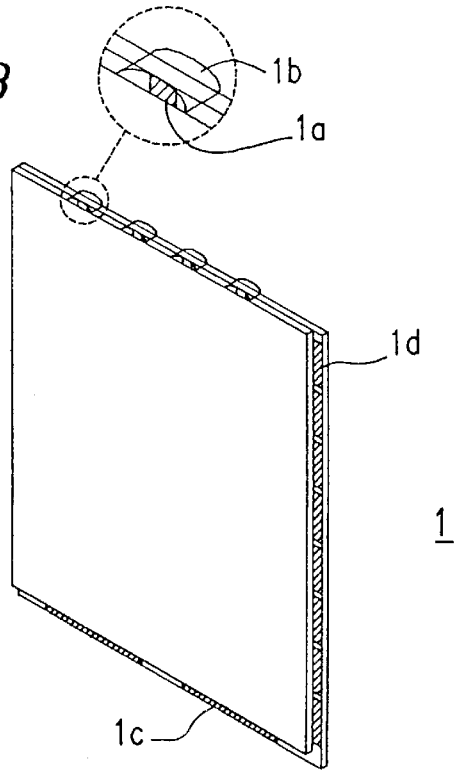
FIG. 1B is an isometric view of the liquid crystal panel.

Referring initially to FIGS. 1A and 1B, FIG. 1A is an isometric view of a sealed bag 2 in the first example according to the present invention. FIG. 1B is an isometric view of the liquid crystal panel 1. In FIG. 1A, the sealed bag 2 packs a liquid crystal panel 1 in a substantially vacuum state (vacuum-pack).

The liquid crystal panel 1 is inserted into the sealed bag 2 in the state where openings la are sealed with a resin 1*b* such as a UV-curable resin pointing upward. Then, the sealed bag 2 is vacuum-packed by a chamber-system vacuum-packing apparatus which evacuates the sealed bag 2 and thermally fuses the opening of the sealed bag 2 simultaneously. In FIG. 1A, reference numeral 3 denotes a fused part. As is shown in FIG. 1B, the liquid crystal panel 1 has a gate electrode 1*c* and a source electrode 1*d* along peripheral surfaces thereof.

Use of the above-described chamber-system vacuum-packing apparatus causes thermal fusion while the entire inner pressure of the bag is reduced. Accordingly, the humidity inside the sealed bag 2 can be sufficiently reduced even in a normal environment. Thus, the temperature and humidity inside the vacuum-packing apparatus need not be controlled.

The sealed bag 2 is thermally fused after the inner pressure of the sealed bag 2 is reduced to about 3 Torr or less by a vacuum pump. The pressure can be reduced to about 3 Torr by evacuating air by, for example, a 105 l/min vacuum pump for about 20 seconds. A sealed bag according to the present invention (described below) can be sealed sufficiently reliably by applying a pressure at about 120° C. for about 0.6 second. These conditions can be appropriately set based on the material, thickness, thermal capacity and the like of the sealed bag. The degree of vacuum inside the sealed bag can be appropriately set based on the resistance against storage environment of the electronic device and storage period. The inner pressure of the sealed bag 2 is preferably 3 Torr or less in the case of storing the liquid crystal panel for about three years or more in a vacuum-packed state under normal environmental conditions.

Figure 2:
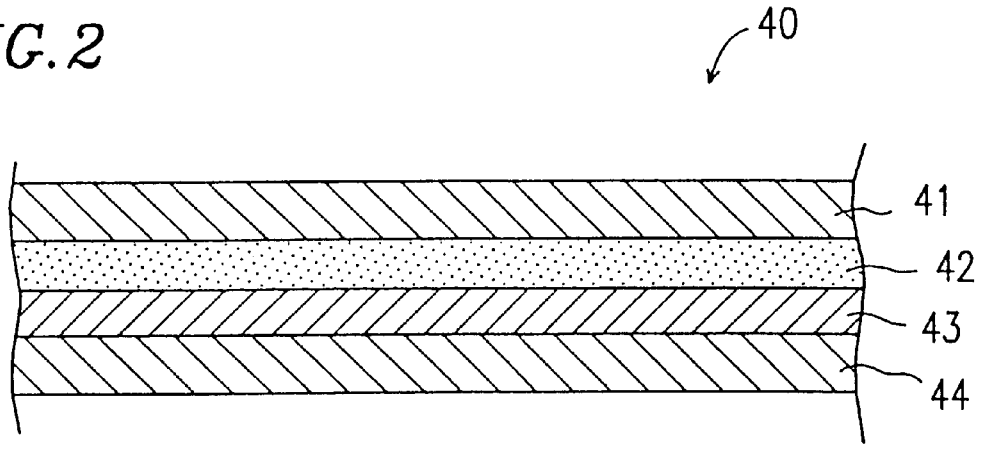
FIG. 2 is a cross sectional view of a charge protective film used for forming the sealed bag.

The sealed bag 2 is formed of multi-layer film. In this example, a four-layer film 40 shown in FIG. 2 is used for forming the sealed bag 2.

The four-layer film 40 includes a first anti-static layer 41, a thin metal layer 42, an insulative layer 43 and a second anti-static layer 44. The metal layer 42 is inside the insulative layer 43, and these two layers are interposed between the first and second anti-static layers 41 and 44. The sealed bag 2 is formed by folding the four-layer film 40 so that the first anti-static layer 41 is the innermost layer and then sealing the film along open sides. One four-layer film 40 can be folded into two, in which case the film is folded along two sides; or two four-layer films 40 can be layered, in which case the film is folded along three sides. After the liquid crystal panel is put in the sealed bag 2, the total of eight layers are fused along the fused part 3.

The four layers of the film 40 each have the following structure. The first anti-static layer 41 and the second anti-static layer 44 each have a thickness of about 30 $\mu$m and are formed of PE and an anion surfactant kneaded thereto. The thin metal film 42 has a thickness of about 12 $\mu$m and is formed of aluminum. The insulative layer 43 has a thickness of about 13 $\mu$m and is formed of PE mixed with no other material. The first and the second anti-static layers 41 and 44 can also formed of PET (polyethylene terephthalate) or LLD (linear low-density polyethylene), as well as PE, mixed with a charge protective material. The insulative layer 43 can be formed of PET, LLD, saponification-copolymer with ethylene-vinylacetate or copolymer with ethylene-vinylalcohol (e.g., Eval produced by Kuraray Co., Ltd.) as well as PE. When necessary, an anti-blocking agent or a slipping agent can be added to the polymer forming the first and second anti-static layers 41 and 44 and the insulative layer 43. The barrier property of the four-layer film 40 is as follows:

Oxygen permeability: 0.1 cc/m$^2$·24 hr·20° C.–100% Rh or less
(conforming to JIS K 7126B)

Water vapor transmission: 0.1 g/m$^2$·24 hr·40° C.–90% Rh or less
(conforming to JIS K 7126B)

The four-layer film 40 is formed by stacking the first anti-static layer 41, the thin metal layer 42, the insulative layer 43 and the second anti-static layer 44 by a known method. For example, the four layers 41 through 44 can be bonded together by an adhesive interposed therebetween. Since the first anti-static layer 41, the insulative layer 43 and the second anti-static layer 44 are formed of a polymer as is described above, the four layers 41 through 44 can be bonded together by heating without using an adhesive (dry bonding).

In still another alternative method of stacking, a charge protective polymer layer is formed on each of the two surfaces of the thin metal film 42, and the first anti-static layer 41 and the insulative layer 43 are bonded with the thin metal film 42 through the polymer layers. A metal layer coated with a charge protective polymer layer is known as a shielding material. The shielding material is one of the wrapping materials which are used for a bag or the like and prevent charge generation caused by friction or the like (e.g., caused when an item accommodated in the bag is frictionally removed or peeled off from the bag). A shielding material is, for example, a -thin metal film of Al, Au, Ag, Fe, Cu or Mg coated with a polymer layer. The polymer layer contains a charge protective organic chemical and a surfactant (for example, an anion surfactant) mixed therewith. Due to such composition, the polymer layer has less electric resistance and thus is more charge protective. The surface resistance of the polymer layer is in the range of $10^3$ Ω to $10^6$ Ω.

The thin metal film 42 is preferably formed of conductive metal material such as Al, Au, Ag, Fe, Cu or Mg, but any other material which has sufficient conductivity and is charge protective can be used. For example, conductive carbon or a conductive polymer can be used.

As is described above, the sealed bag 2 includes the first anti-static layer 41, the thin metal layer 42, the insulative layer 43 and the second anti-static layer 44. The innermost layer is the first anti-static layer 41, and the outermost layer is the second anti-static layer 44. Due to such a structure, even if electrostatic charge is generated inside the sealed bag 2 when the sealed bag 2 is opened and the liquid crystal panel 1 is frictionally removed or peeled off from the sealed bag 2, such electrostatic charge flows from the first anti-static layer 41 to the thin metal layer 42 and diffused in these two layers. Accordingly, generation of an excessively high voltage in a local area is prevented. Electrostatic charge which is generated outside the sealed bag 2 is diffused in the second anti-static layer 44, thus preventing an excessively high voltage from being generated locally outside the sealed bag 2. The insulative layer 43 provided between the second anti-static layer 44 and the thin metal layer 42 prevents outside electrostatic charge from reaching the inside of the sealed bag 2. The thin metal layer 42, which has an excessively low gas permeability, prevents invasion of humidity and air from outside and thus maintains the high degree of vacuum inside the sealed bag 2.

The sealed bag 2 includes four layers in this example, but can include other layers. For example, a protective layer can be provided inside the first anti-static layer 41. As the protective layer, a PET layer or the like can be used. The insulative layer 43 and the first and second anti-static layers 41 and 44 can each include a plurality of layers which are formed of different materials.

The first anti-static layer 41 preferably has a surface resistance of $10^5$ Ω to $10^9$ Ω in order to diffuse the electrostatic charge generated inside the sealed bag 2. The thin metal layer 42 coated with a charge protective polymer layer preferably has a surface resistance of $10^3$ Ω to $10^6$ Ω also in order to diffuse the electrostatic charge generated inside the sealed bag 2. The insulative layer 43 preferably has a surface resistance of $10^{12}$ Ω or more in order to prevent the electrostatic charge from flowing in the thickness direction of the sealed bag 2 especially from outside to inside the sealed bag 2. The second anti-static layer 44 preferably has a surface resistance of $10^{15}$ Ω to $10^{9}$ Ω in order to diffuse the electrostatic charge generated outside the sealed bag 2.

Case

Figure 4:
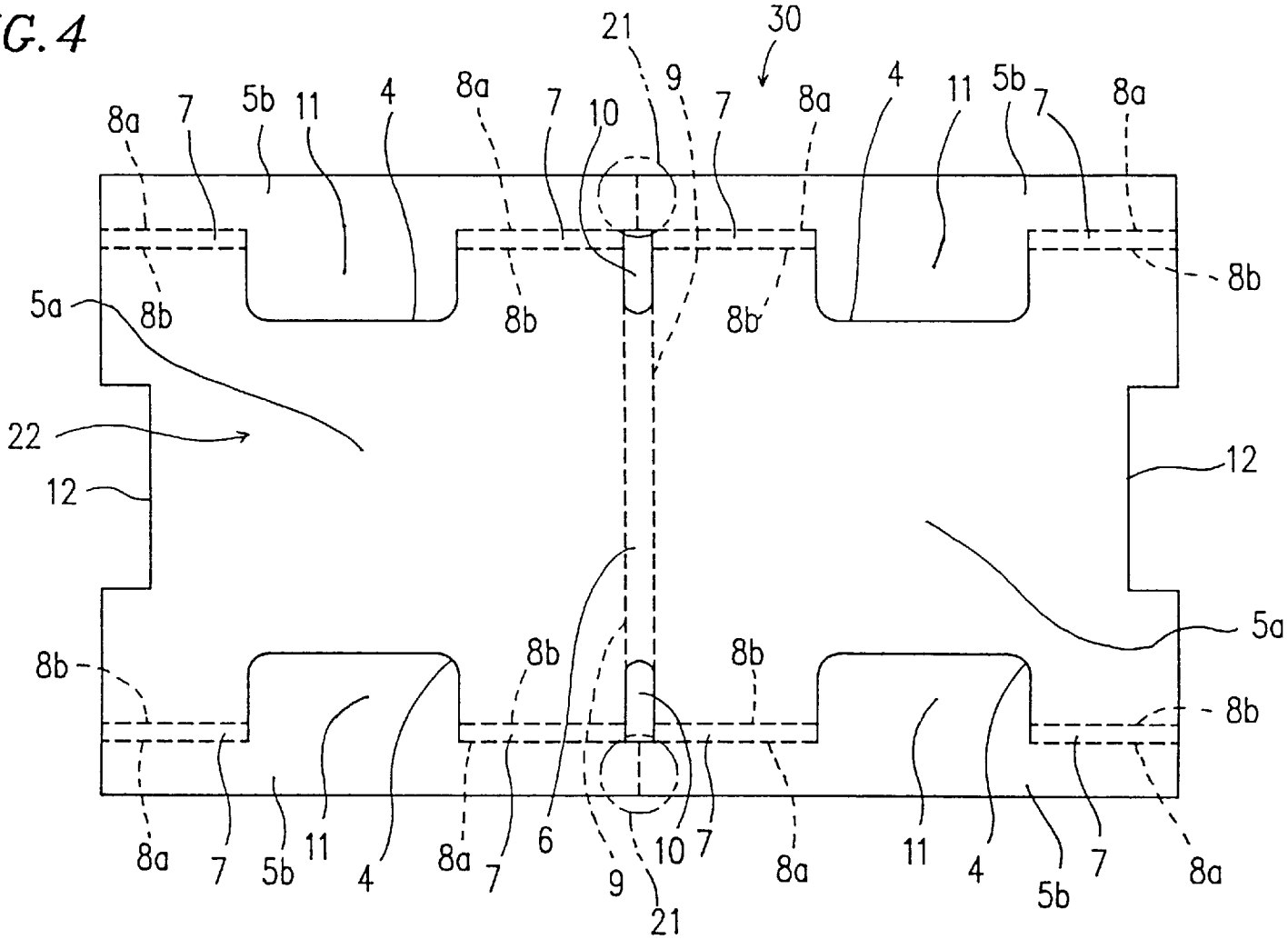
FIG. 4 is a developed view of a case in the first example for accommodating the plurality of sealed bags.

FIG. 4 is a developed view of the case 30 for accommodating two sealed bags 2. The case 30 is formed of a single sheet of cardboard.

The cardboard includes flap parts 5*b* which will partially cover the sealed bags 2 when the sealed bags 2 are put in the case 30, and central parts 5*a* on which the sealed bags 2 will be put.

Figure 5A:
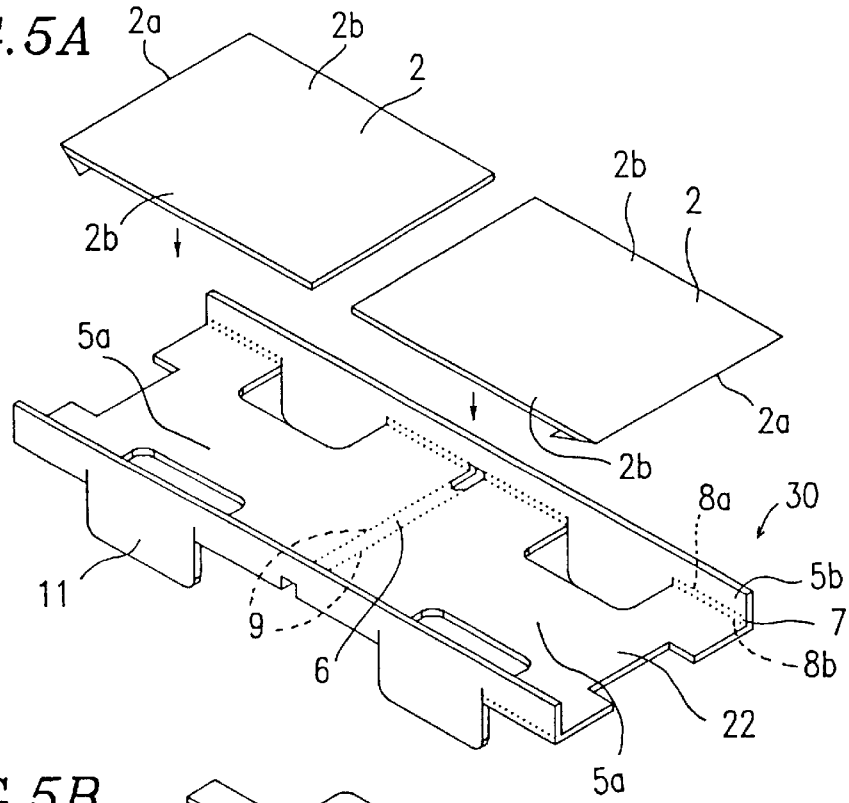
FIGS. 5A through 5C are isometric views illustrating a method for forming the case.
Figure 5B:
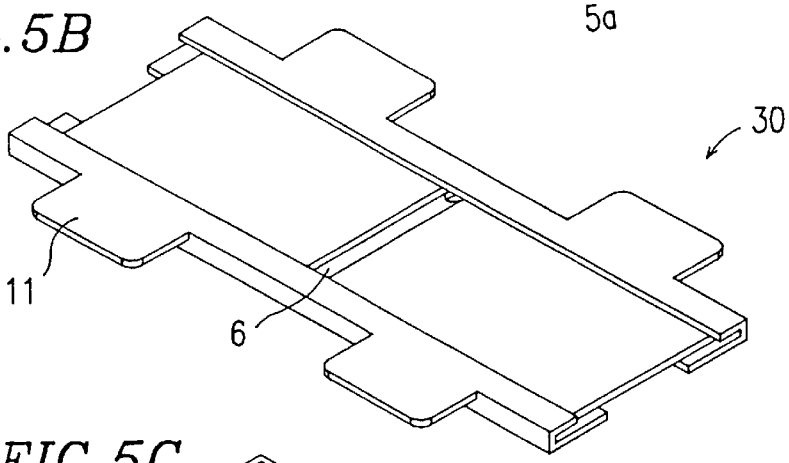
Figure 5C:
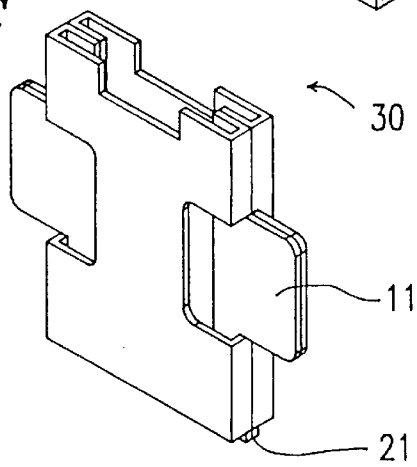

The cardboard is formed into the case 30 as is illustrated in FIGS. 5A through 5C. First, the cardboard is cut along lines 4 in order to facilitate making tabs 11. By folding flap parts 5*b* along folding lines 8*b* in an inward direction toward the center of the cardboard, tabs 11 are caused to protrude downwards as is shown in FIG. 5A. Then, areas 10 (see FIG. 4) are cutout. Thus, the cardboard is shaped as is shown in FIG. 5A and is shaped in a manner conducive for receiving the sealed bags 2.

Two sealed bags 2 are each folded along the fused part 3 (see FIG. 1A) into a prescribed size, and put on the central parts 5*a* as is shown in FIG. 5A, with a folding edge 2*a* pointing outward in the longitudinal direction of the cardboard. The sealed bag 2 includes a liquid crystal panel 1 in such a direction that the openings 1*a* (see FIG. 1B) are aligned along the folding edge 2*a*.

Next, as is shown in FIG. 5B, the flap parts 5*b* are further folded along folding lines 8*a* inward toward the center of the cardboard until they overlap the sealed bags 2, thus securing the bags 2. At this point, the tabs 11 are protruding outwards away from the center of the cardboard as is readily seen in FIG. 5B. Thus, the side areas 2*b* of the sealed bags 2 are lightly pressed by the flap parts 5*b* and safely secured.

Then, as is shown in FIG. 5C, the cardboard is folded in two along folding lines 9 (see FIG. 5A) so that the exposed parts of the sealed bags 2 are inside. Thus, the case 30 is completed.

As is shown in FIGS. 4 and 5C, the central parts 5*a* each have a cutout 12, which forms a recess 33 as is described later.

The case 30 is then put into the housing 31 with a part 6 between folding lines 9 pointing downward. The case 30 can be put in the housing 31 relatively easily by inserting the tabs 11 protruding outward into grooves 13*a* in inner surfaces of the housing 30. Each pair of tabs 11 along each side of the case 30 is inserted into one groove 13*a*. Projections 21 of the case 30 (FIG. 5C) are inserted into grooves 13*b* (FIGS. 7 and 8) of the housing 31. Accordingly, the sealed bags 2 are supported by part 6 of the case 30.

The case 30 is provided with a charge protective layer formed of a charge protective material at least on areas which are to be in contact with the sealed bags 2, namely, inner surfaces of the flap parts 5*b*, the central parts 5*a*, part 6, and part 7 between folding lines 8*a* and 8*b*. In this example, an aluminum (Al) layer 22 formed of an aluminum foil having a thickness of about 14 μm is bonded with an adhesive containing vinyl acetate. The entire inner surface of the case 30 is coated with the Al layer 22 in order to obtain electric contact with the sealed bags 2 relatively easily.

Figure 6:
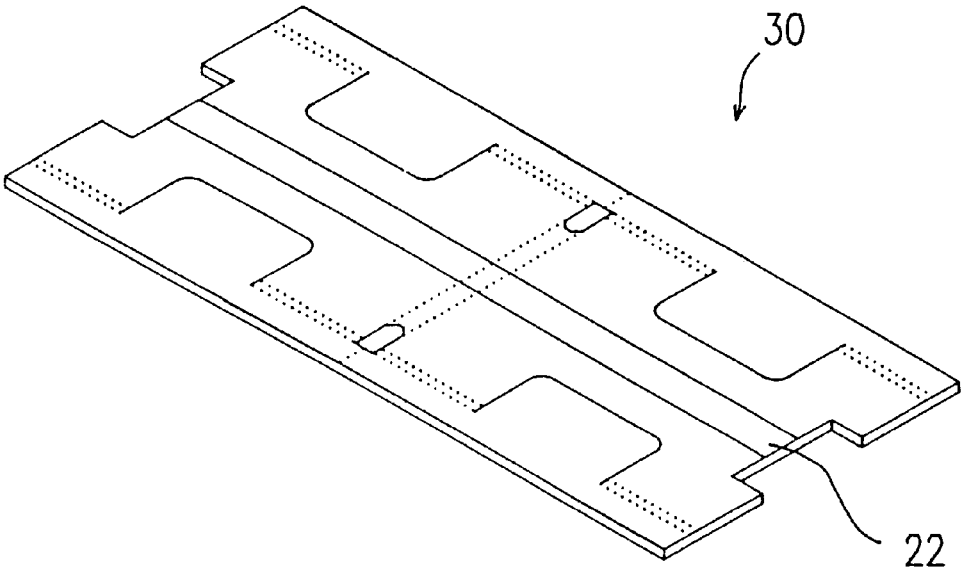
FIG. 6 is an isometric view illustrating an alternative example of the case.

As is shown in FIG. 6, the charge protective layer can be provided in the form of a strip along the center line of the central parts 5*a*, or a plurality of such layers can be formed. The number and shape of the charge protective layer can be varied as long as the sealed bags 2 and the inner surface of the case 30 are electrically connected to each other to sufficiently diffuse electrostatic charge in the case 30. The charge protective layer can be formed of other types of metal or carbon, as well as aluminum.

As is described above, the electrostatic charge from outside can be diffused by electric connection between the sealed bags 2 and the case 30. Thus, concentration of electrostatic charge in a local area is prevented, and the liquid crystal panel 1 is more effectively protected against electrostatic destruction.

Housing

Figure 7:
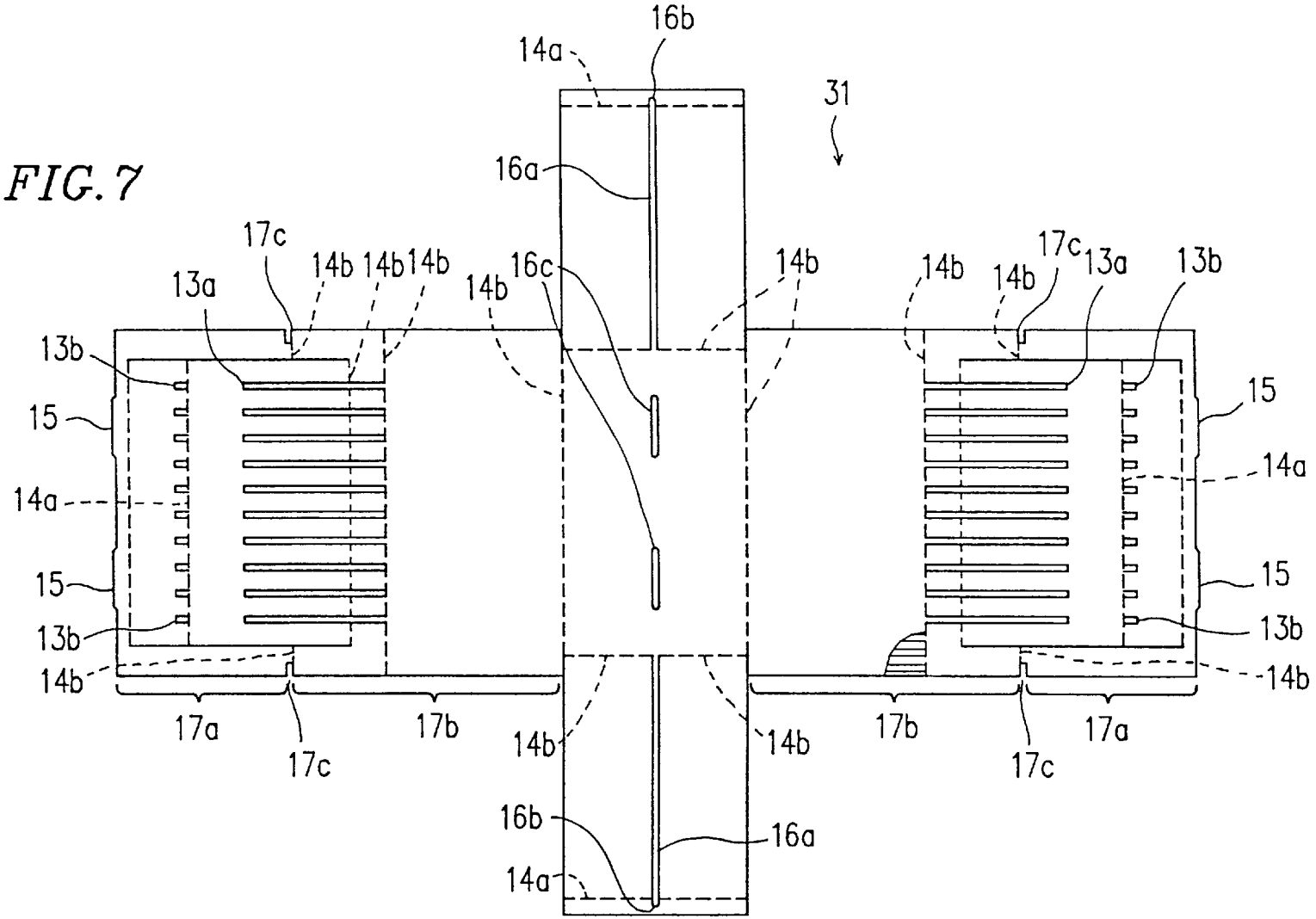
FIG. 7 is a developed view of a housing in the first example for accommodating the plurality of cases.
Figure 8:
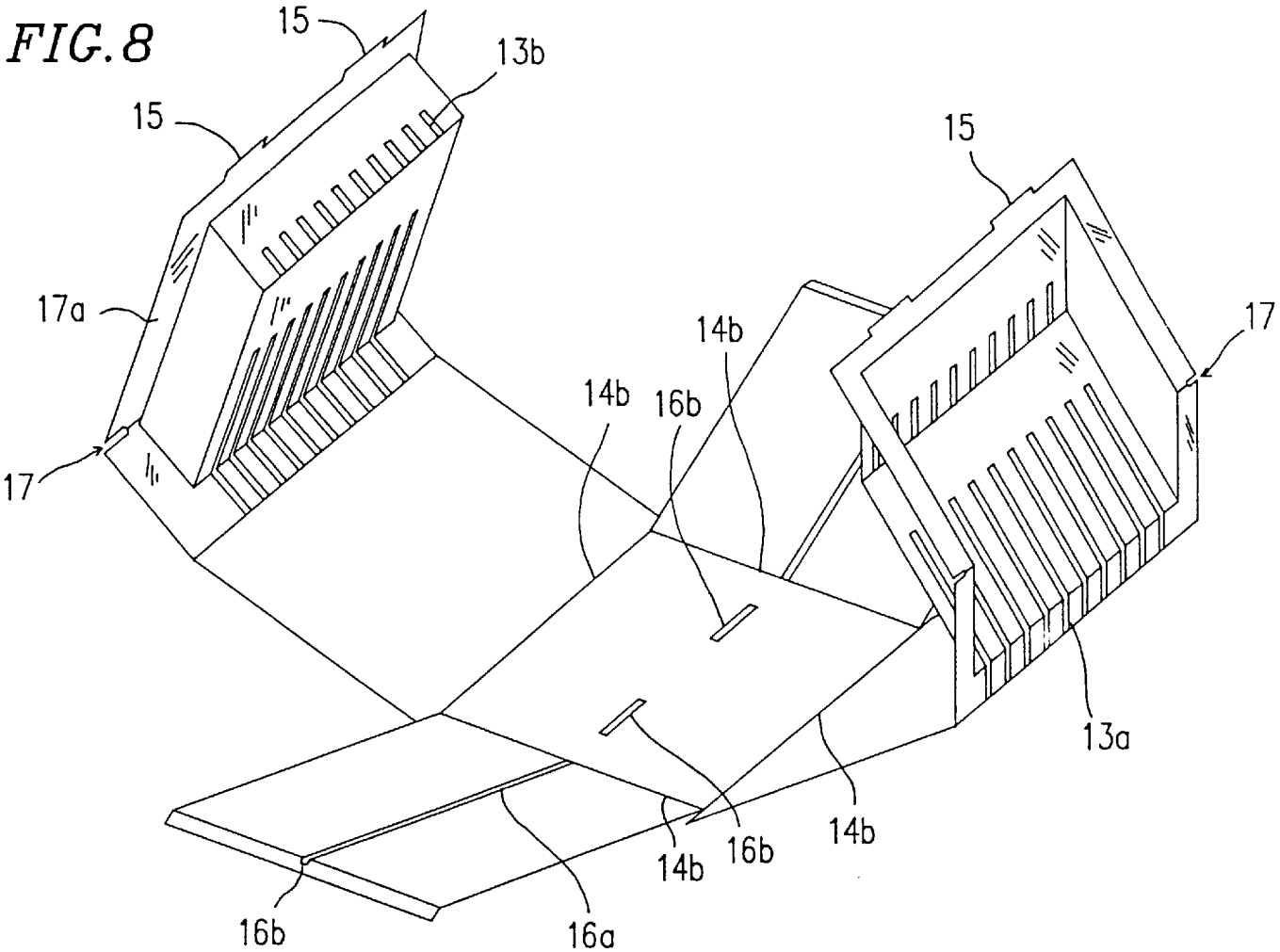
FIG. 8 is a view illustrating a method for forming the housing.

FIG. 7 is a partial cross sectional, developed view of the housing 31 formed of a single sheet of cardboard. The cardboard is folded inward toward the center of the cardboard along folding lines 14*b* as is shown in FIG. 8. Additionally, the cardboard is folded outwardly away from the center of the cardboard along lines 14*a* as is shown in FIG. 8.

Projections 15 are inserted into slots 16*c*. Then, side parts 17*a* are inserted into slots 16*a*, and cutouts 17*c* are engaged with ends 16*b* of the slots 16*a*. Thus, as is shown in FIG. 3, the side parts 17*a* are located along the center of surfaces 35 of the housing 31, and side parts 17*b* are located along the end of the surfaces 35.

As is described above, the housing 31 can be assembled relatively easily with no adhesive.

Since the case 30 is supported by the housing 31 through the tabs 11 inserted into the grooves 13*a* and the projections 21 inserted into the grooves 13*b*, the liquid crystal panel 1 vacuum-packed in the sealed bag 2 is not directly exposed to any external force, vibration or impact. Furthermore, the cardboard is flexible and deformable, and absorbs external force, vibration and impact.

Holder

Figure 9:
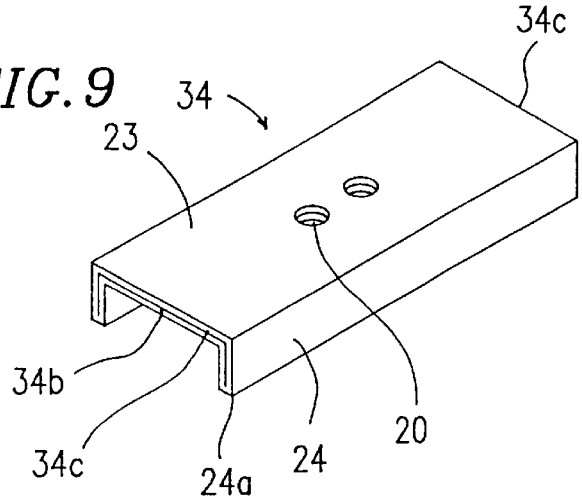
FIG. 9 is an isometric view of a holder in the first example to be mounted on the plurality of cases accommodated in the housing.

FIG. 9 is an isometric view of the holder 34. As is shown in FIG. 3, the holder 34 is put in each housing 31. In detail, the holder 34 is fit in the recess 33 which is formed by a plurality of cutouts 12 (FIG. 4) of the plurality of cases 30 aligned in the housing 31. The cases 30 are held by the holder 34 fit in the recess 33.

Figure 10:
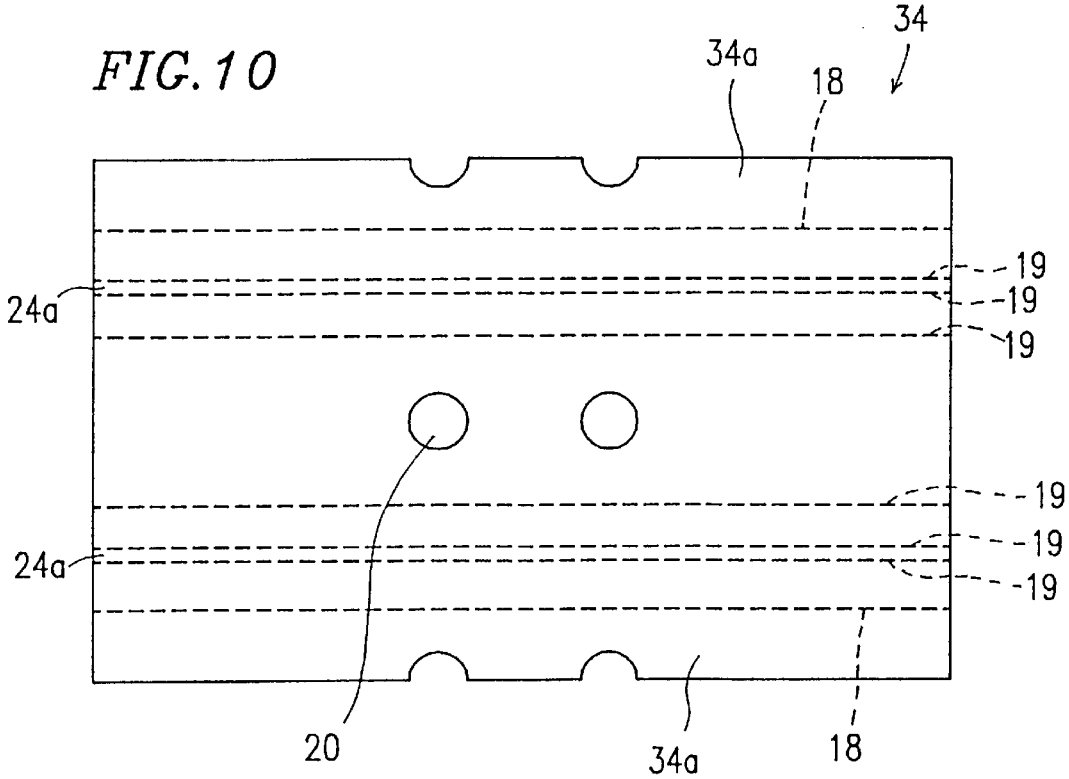
FIG. 10 is a developed view of the holder.

FIG. 10 is a developed view of the holder 34 formed of a single sheet of cardboard. The cardboard is folded along folding lines 18 inwards toward the center of the cardboard and folded along folding lines 19 outwards away from the center of the cardboard. Thus, the holder 34 shown in FIG. 9 is formed. In order to facilitate mounting of the holder 34 into the recess 33, the holder 34 has two through-holes 20. The user can insert his/her fingers into the through-holes 20 when handling the holder 34.

Outer surfaces of the holder 34 is provided with a charge protective layer. In this example, the entire outer surface, namely, a top surface 23, outer surfaces of legs 24, and bottom surfaces 24*a* of the legs 24 are coated with an Al layer. When the holder 34 is fit in the recess 33, the bottom surfaces 24*a* are electrically connected with the sealed bags 2 exposed by the cutouts 12. In order to provide electric connection more effectively, the bottom surfaces 24*a* can have a plurality of dents, into which the sealed bags 2 are engaged. Alternatively, the bottom surfaces 24*a* can be enlarged. As is described later, the outer surface 23 is electrically connected with an inner surface of the master carton 32.

The holder 34 is in contact with each sealed bag 2 at only two ends of a top side thereof, and further the sealed bag 2 is supported by part 6 on the bottom as is described above. Accordingly, no stress is applied to the openings la of the liquid crystal panel 1.

Parts 34*a* (FIG. 10) are fixed to the top surface 23 by, for example, an adhesive tape applied along sides 34*c*. As the adhesive tape, a thin film formed of a charge protective material provided with an adhesive agent on one surface thereof, for example, an Al adhesive tape is preferably used. Since electrostatic charge is diffused in more paths in this manner, the liquid crystal panels 1 accommodated in the case 30 are protected against electrostatic charge more effectively.

Master carton

Referring to FIG. 3 again, after the holders 34 are mounted in the recesses 33, the master carton 32 is closed. The master carton has lids 25 (only one is shown), which are each provided with an Al layer as a charge protective layer on an inner surface thereof. When the lids 25 are closed, the Al layers on the lids 25 are put into contact with the top surfaces 23 of the holders 34 to cause electric connection. The Al layers can be provided on the entire surfaces of the lids 25 or only on parts thereof which are to be put in contact with the top surfaces 23 of the holders 34.

As is described above, the liquid crystal panel 1 is reliably protected against electrostatic charge by the sealed bag 2, the case 30, the holder 34, and the master carton 32 which are electrically connected to each other via the charge protective layers. The housings 31 do not have a charge protective layer in this example, but can be provided with a charge protective layer on an inner surface thereof to be electrically connected to the case 30 via the tabs 11. All the charge protective layers are preferably but not necessarily connected electrically. As the charge protective layers have a larger area, the liquid crystal panels 1 are more effectively protected against electrostatic charge. The charge protective layers do not generate electrostatic charge, and electrostatic charges generated in other parts are diffused in the charge protective layers and tend to be removed.

As is shown in FIG. 3, floppy disks or the like can be pasted with an adhesive tape or the like between a top surface of the housings 31 and the master carton 32. In this manner, the floppy disks are also protected against electrostatic charge, and external vibration and impact.

Evaluation

A liquid crystal panel which is representative of electronic devices that can be destroyed relatively easily by electrostatic charge are accommodated, stored and transported in a sealed bag and case according to the present invention for evaluation of the sealed bag and case.

A liquid crystal panel includes a great number of pixels, switching devices such as transistors for controlling the pixels, wires for connecting the transistors, and many other circuit elements. Such circuit elements are electrically insulated if necessary. When electrostatic charge is applied to the liquid crystal panel, the insulation may be broken, or the transistors may be destroyed. For example, a gate electrode and a source electrode insulated from each other may be shortcircuited by high voltage caused by electrostatic charge, resulting in defective display.

One exemplary method for evaluating the resistance against electrostatic charge of a liquid crystal panel is a surge test. Typically, electrostatic destruction in a liquid crystal panel occurs when a voltage of several ten volts or more is applied. However, in a liquid crystal panel vacuum-packed in a sealed bag according to the present invention and further accommodated in a case according to the present invention, electrostatic destruction does not occur even when voltage of as high as 50 kV is applied. Such a test result indicates that the liquid crystal panel is protected to a satisfactory level of reliability against electrostatic charge by the sealed bag and the case.

When inserting and vacuum-packing the liquid crystal panel 1 in the sealed bag 2, the operator has to use clothes, shoes, gloves, fingerstall, earthband and the like which are processed to be anti-static. However, the sealed bag 2 vacuum--packing the liquid crystal panel 1 can be input to the case 30 under normal environmental conditions without using anti-static items since the liquid crystal panel 1 is protected against electrostatic charge by the sealed bag 2.

In another test, liquid crystal panels 1 vacuum-packed in sealed bags 2 according to the present invention are stored for one year at temperatures in the range of −35° C. to 65° C. at a relative humidity of 95%. The test does not result in corrosion of wires (for example, the gate electrode 1*c* or the source electrode 1*d*), electrostatic destruction, or quality deterioration.

When the conventional bags are used, the sealing resin at the openings 1*a* is delaminated in 30% or more of the liquid crystal panels 1 at such high humidity. By contrast, the liquid crystal panels 1 vacuum-packed in the sealed bags 2 according to the present invention do not show any such defect. Such a test result indicates that the sealed bags 2 according to the present invention protect the liquid crystal panels 1 against electrostatic charge and also against outside humidity.

In still another test, a case 30 according to the present invention accommodating the sealed bags 2 each vacuum-packing a liquid crystal panel 1 is dropped from a height of 75 cm at various angles to evaluate the damage to the liquid crystal panels 1. The liquid crystal panels are not damaged at any angle. Such a test result indicates that the case 30 according to the present invention sufficiently protects the liquid crystal panels 1 against external impact.

In the above example, the present invention is applied to a liquid crystal panel, but the present invention is applicable to any other electronic device, for example, a printed circuit board.

As is described above, a sealed bag according to the present invention protects an electronic device vacuum-packed therein against the external humidity and electrostatic charge during storage and transportation. Accordingly, the electronic device can be stored and transported for a relatively long period of time and under relatively severe environmental conditions. Even when the electronic device is peeled off or frictionally removed from the sealed bag, the electronic device is protected against electrostatic charge.

The container in the first example can store and transport a plurality of electronic devices each vacuum-packed in a sealed bag for a relatively long period of time in relatively severe environmental conditions. A case for accommodating the sealed bags is provided with a layer formed of a charge protective material on a partial or the entire inner surface thereof. Accordingly, the case can protect the sealed bags and the electronic devices against external electrostatic charge and the like.

The case is formed relatively easily by folding a single sheet of cardboard without using any adhesive material. The case preferably has a tab along a periphery thereof which is used for guiding and securing the case in a housing. The housing is also formed relatively easily by folding a cardboard without using any adhesive material. The housing preferably has grooves to be engaged with the tabs. Such grooves secure the case relatively easily and further maintain a prescribed space between adjacent cases.

The container, which is formed of paper-based material, can be produced at a cost which is 30% less than that of a container formed of styrol. Since paper, unlike styrol, does not have to be recovered for special disposal, the cost savings associated with paper is furthered. The cardboard is sufficiently light and still sufficiently resistant against vibration and impact. Moreover, the paper can be recycled and thus is favorable from an environment conservation point of view.

EXAMPLE 2

Figure 11:
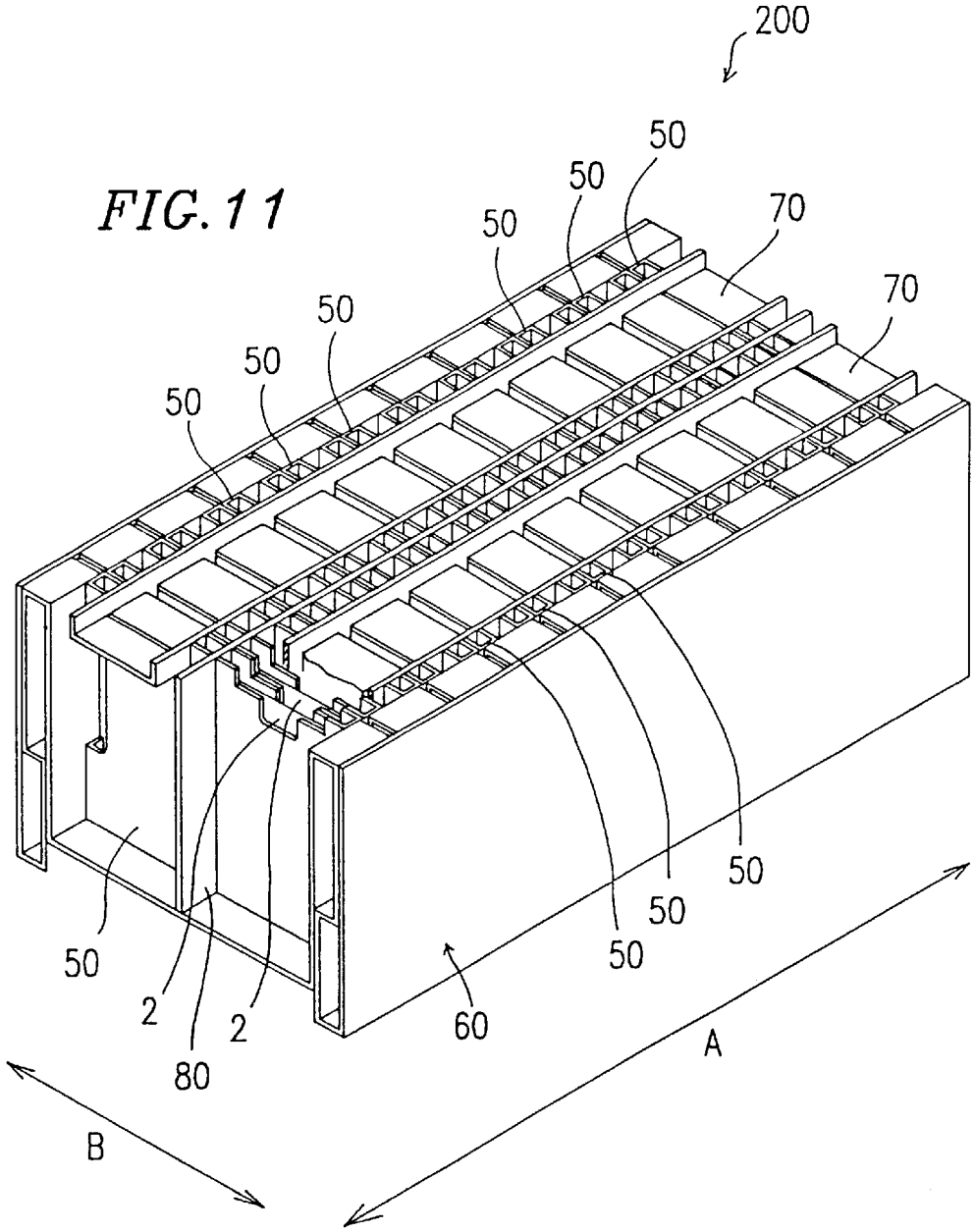
FIG. 11 is an isometric view of a container in a second example according to the present invention for accommodating a plurality of sealed bags each of which vacuum-packs a liquid crystal panel.

FIG. 11 shows an isometric view of a container 200 for accommodating a liquid crystal panel in a second example according to the present invention. The liquid crystal panel 1 and a sealed bag 2 which are accommodated in a second example have the same structure as in the first example, thus a detailed explanation thereof will be omitted.

As is shown in FIG. 11, the container 200 includes a substantially C-shaped housing 60 and two holders 70. The housing 60 accommodates a plurality of cases 50 arranged in the direction of arrow A (direction A or a first direction). Each case 50 accommodates four sealed bags 2, namely, two in direction A by two in the direction of arrow B (direction B or a second direction) perpendicular to direction A. The holders 70 extend along direction A so as to hold the cases 50. The cases 50 arranged in direction A are each separated into two by a partition 80.

The cases 50, the housing 60, the holders 70, and the partition 80 are all formed of a single sheet of cardboard.

Case

Figure 12:
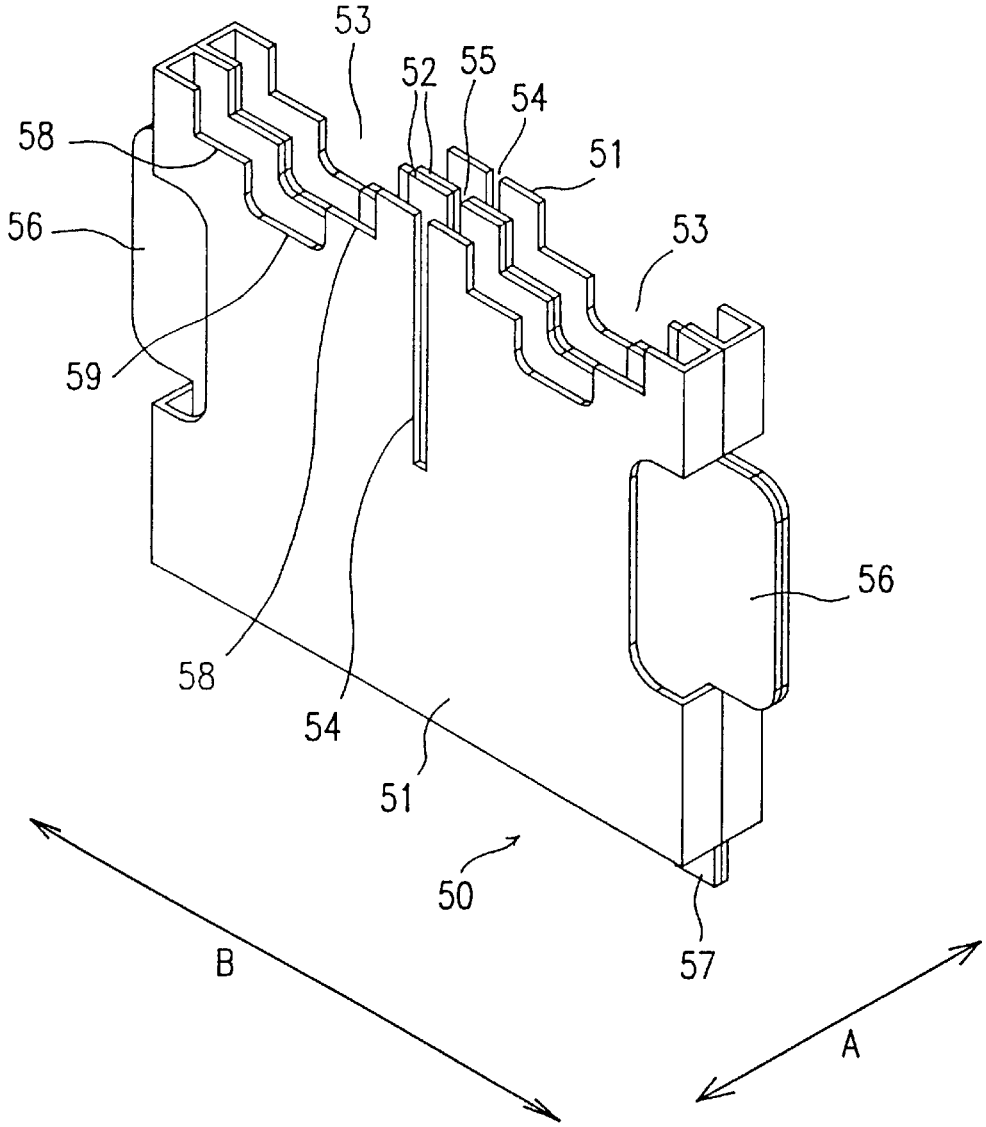
FIG. 12 is an isometric view of a case in the second example for accommodating the plurality of sealed bags.

FIG. 12 is an isometric view of the case 50. As is shown in FIG. 12, the case 50 has two accommodation spaces, each defined by an outer wall 51 and an inner wall 52. Each accommodation space can accommodate two sealed bags 2 side by side in direction B. The case 50 can accommodate four sealed bags 2 totally.

The outer walls 51 and the inner walls 52 are cutout to have two recesses 53. The recesses 53 each have a two-step shape. In detail, symmetrical first steps 58 flank a second step 59. The outer walls 51 each have a slit 54 extending downward from a top edge to a middle point thereof, and the inner walls 52 each have a slit 55 (not completely shown) extending from a top edge to a bottom edge thereof.

The case 50 further has tabs 56 protruding outward in direction B and projections 57 at two ends of a bottom surface thereof in direction B.

Figure 13:
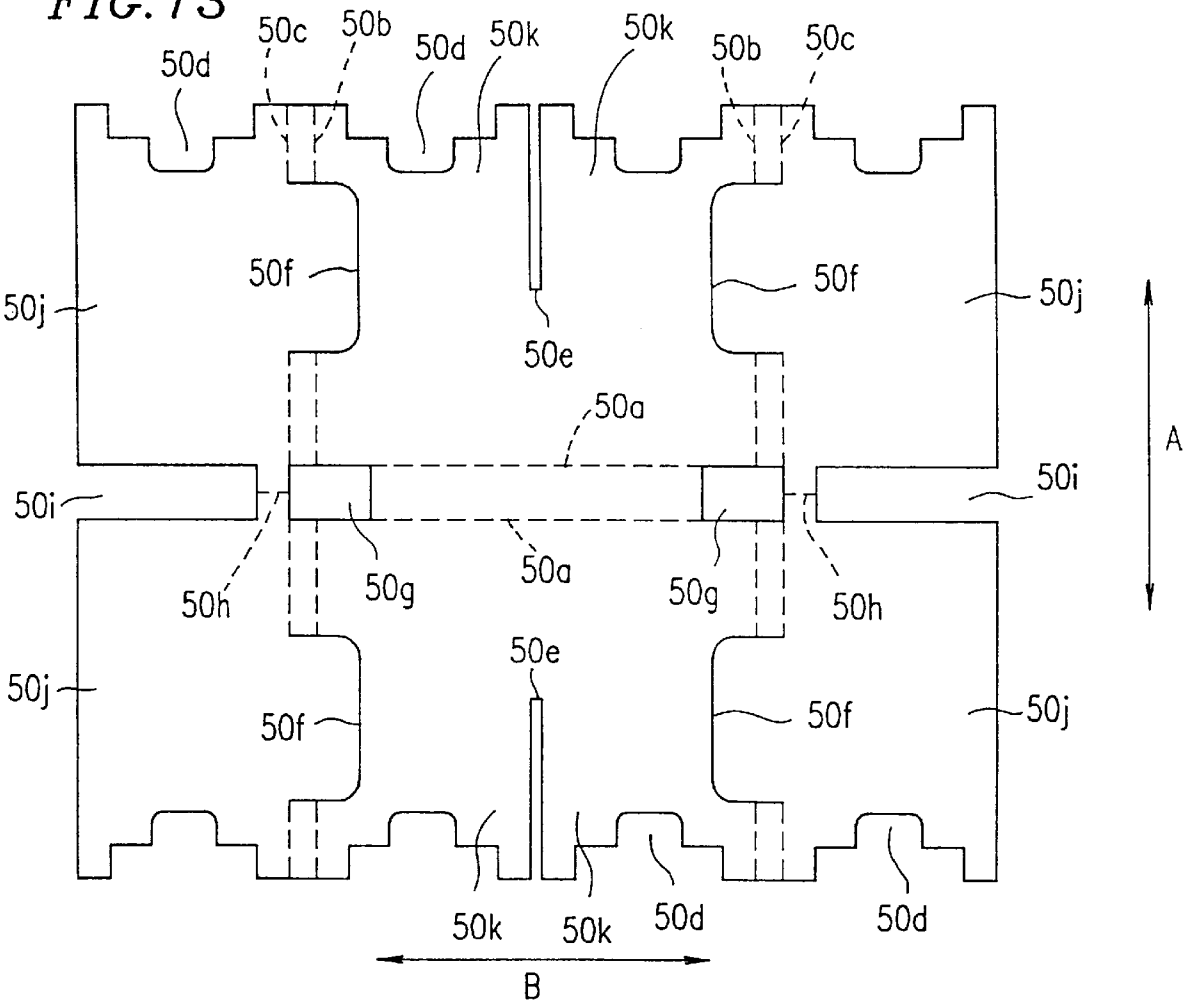
FIG. 13 is a developed view of the case in the second example.

FIG. 13 is a developed view of a cardboard to be formed into the case 50. The cardboard is substantially rectangular with longer sides extending in the direction corresponding to direction B and shorter sides extending in the direction corresponding to direction A.

As is shown in FIG. 13, the cardboard has central parts 50*k* which form the outer walls 51, and flap parts 50*j* which form the inner walls 52. The cardboard further has central folding lines 50*a* extending in direction B, symmetrical side folding lines 50*b* extending in direction A, symmetrical side folding lines 50*c* also extending in direction A outside folding lines 50*b*.

The longer sides of the cardboard each have four cutouts 50*d* which form the recess 53 and also have a slit 50*e* which form the slit 54. The cardboard is cut along four lines 50*f* interrupting folding lines 50*b* and 50*c*. The cardboard further has rectangular cutouts 50*g*, folding lines 50*h*, and cutouts 50*i* outside folding lines 50*a*.

The cardboard is formed into the case 50 as is illustrated in FIGS. 14A through 14D.

Figure 14A:
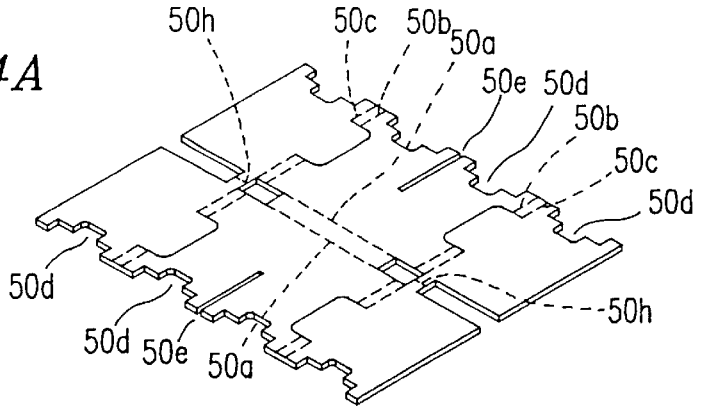
FIGS. 14A through 14D are isometric views illustrating a method for forming the case.
Figure 14B:
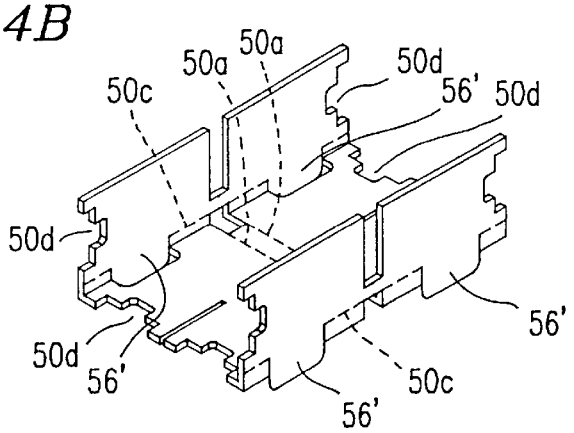

First, as is shown in FIGS. 14A and 14B, by folding the flap parts 50*j* inwardly along folding lines 50*b*, projections 56' are caused to protrude downwards as is shown in FIG. 14B. The projections 56' form the tabs 56.

Figure 14C:
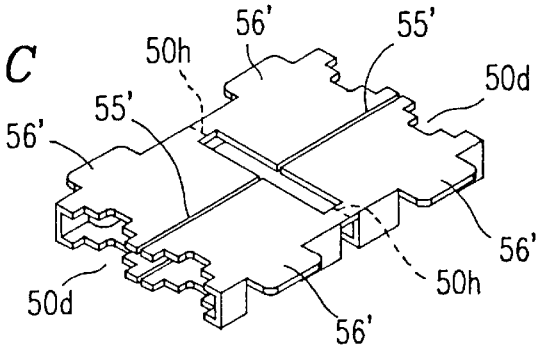

Next, as is shown in FIG. 14C, the flap parts 50*j* are further folded along folding lines 50*c* inwards toward the center of the cardboard until they overlap the central parts 50*k*. At this point, the projections 56' are protruding outwards away from the center of the cardboard as is seen in FIG. 14C. Gaps 55' between the flap parts 50*j* form the slit 55.

Figure 14D:
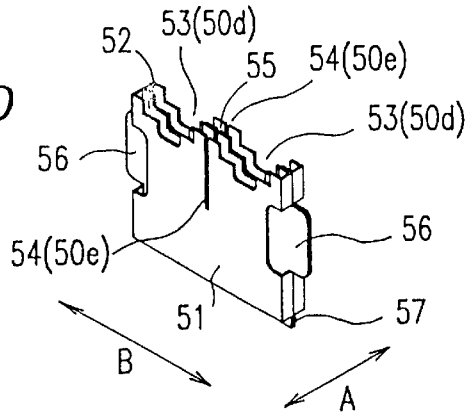

Then, the cardboard is folded along folding lines 50*a* and 50*h* so as to put the flap parts 50*j* into contact with each other, thereby forming the case 50 as is shown in FIG. 14D. The flap parts 50*j* form the inner walls 52, and the central parts 50*k* form the outer walls 51.

The case 50 has two accommodation spaces each defined by the outer wall 51 and the inner wall 52. The cutouts 50*d* form the two recesses 53, and the projections 56' protruding in direction B in each side are assembled to form the tabs 56. The parts folded along folding lines 50*h* form the projections 57. The gaps 55' form the slit 55, and the slits 50*e* form the slits 54.

Four sealed bags 2 each vacuum-packing a liquid crystal panel 1 are put in the case 50, for example, after the cardboard is folded along folding lines 50*b* but before being folded along folding lines 50*c*.

An inner surface of the case 50 is partially or entirely coated with a charge protective layer, for example, an Al layer having a thickness of about 13 $\mu$m in order to protect the liquid crystal panels 1 against electrostatic charge.

Housing

Figure 15:
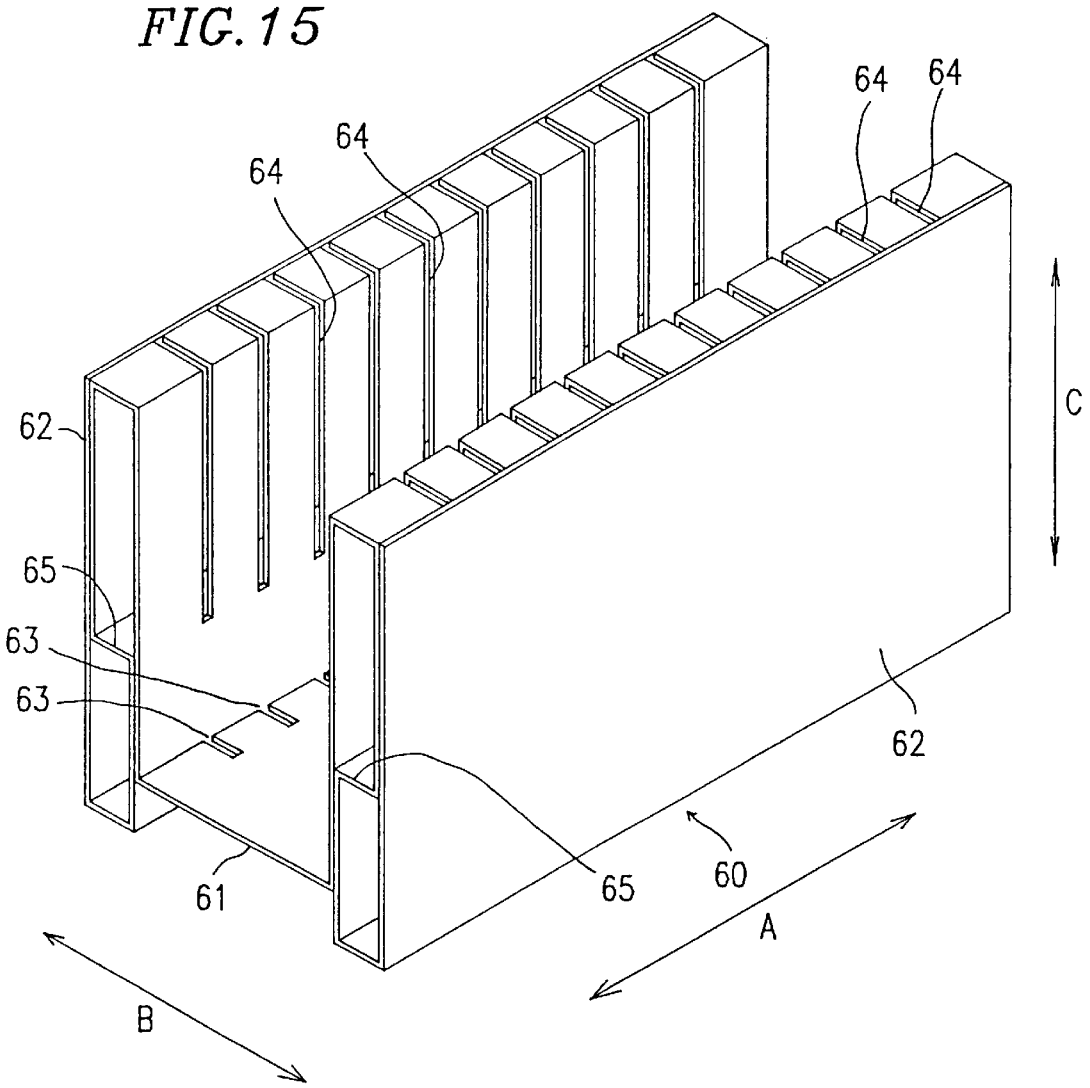
FIG. 15 is an isometric view of a housing in the second example for accommodating the plurality of cases.

FIG. 15 is an isometric view of the housing 60. The housing 60 includes a bottom plate 61 and two side walls 62 extending in the direction of arrow C (direction C or a third direction) perpendicular to both of directions A and B. The bottom plate 61 is slightly elevated from the bottom surfaces of the side walls 62. The bottom plate 61 has a plurality of slits 63 formed with a prescribed interval along two sides thereof in direction A, into which the projections 57 of the cases 50 are to be engaged. The side walls 62 each have the shape of a hollow rectangular pillar reinforced by a horizontal plate 65 in the middle. Furthermore, the side walls 62 each have a plurality of slits 64 extending from a top surface to an inner side surface thereof, into which the tabs 56 of the cases 50 are to be inserted. The slits 64 positionally correspond to the slits 63. The housing 60 is formed of a single sheet of cardboard.

Figure 16:
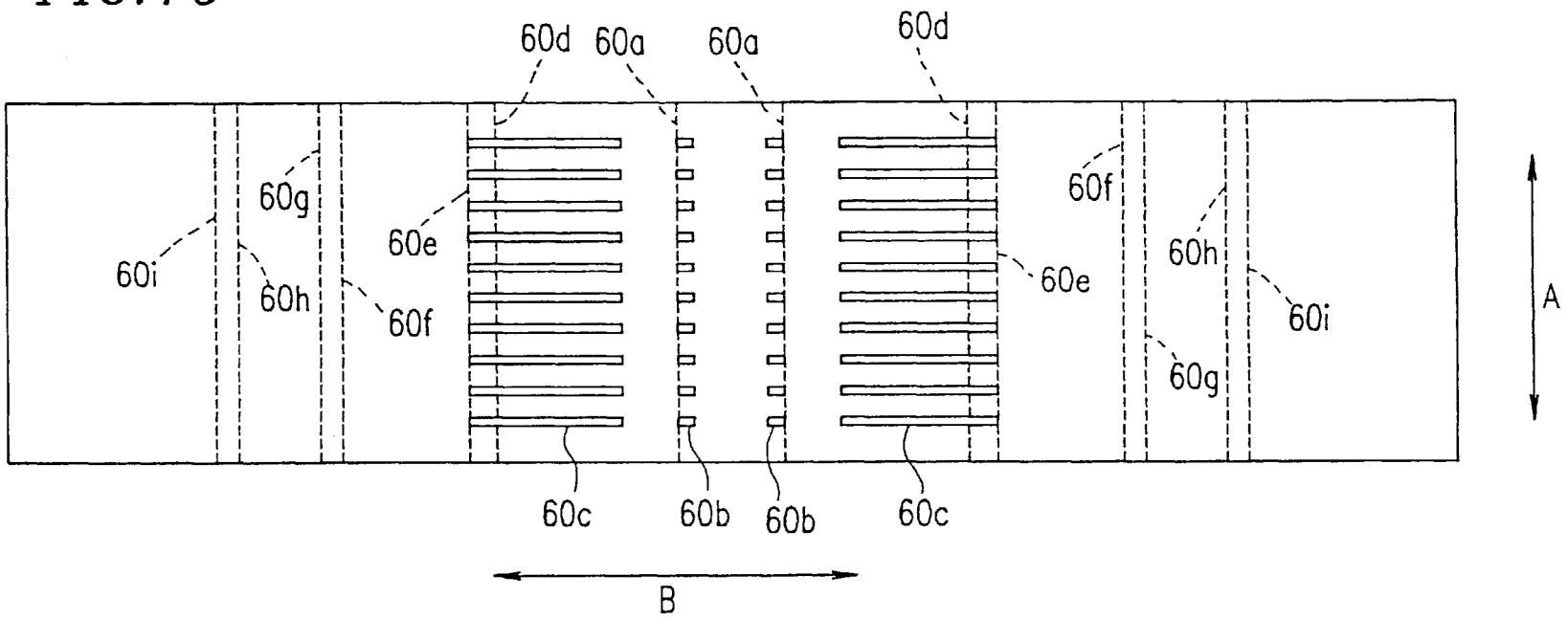
FIG. 16 is a developed view of the housing.

FIG. 16 is a developed view of the housing 60. The cardboard has a rectangular shape with longer sides extending in the direction corresponding to direction B and shorter sides extending in the direction corresponding to direction A. The cardboard has central folding lines 60*a* extending in direction A, and cutouts 60*b* inside folding lines 60*a*, which form the slits 63. Outside folding lines 60*a*, the cardboard has cutouts 60*c*, which form the slits 64, and also folding lines 60*d* and 60*e*. Outside folding lines 60*e*, the cardboard further has folding lines 60*f*, 60*g*, 60*h* and 60*i*.

The cardboard is formed into the housing 60 as is illustrated in FIGS. 17A through 17D.

Figure 17A:
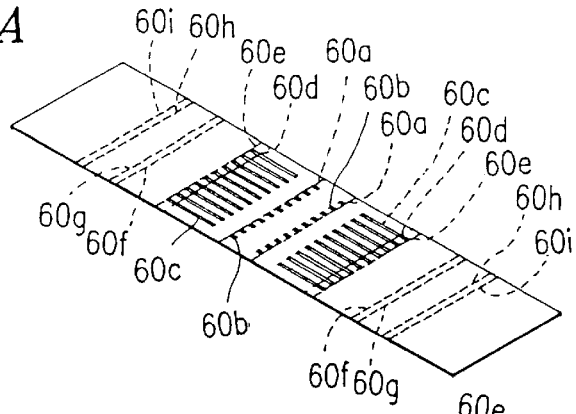
FIGS. 17A through 17D are isometric views illustrating a method for forming the housing.
Figure 17B:
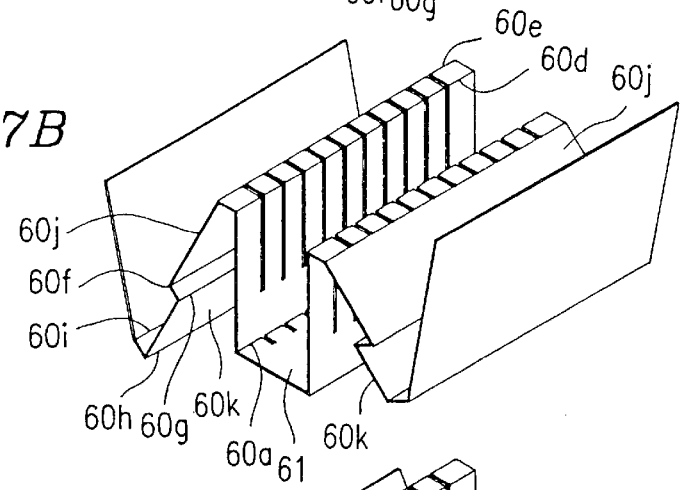
Figure 17C:
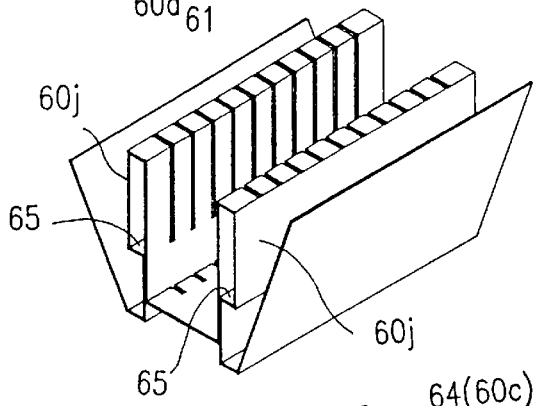
Figure 17D:
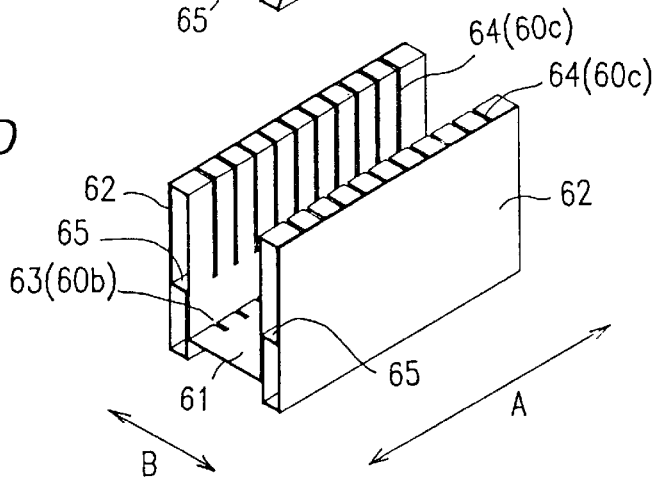

First, as is shown in FIGS. 17A and 17B, the cardboard is folded inwardly along folding lines 60*a* toward the center of the cardboard. Thus, the bottom plate 61 is formed although not elevated yet. Then, the cardboard is folded along folding lines 60*d*, 60*e* and 60*f* outwardly away from the center of the cardboard, and then folded inwardly along folding lines 60*g*, 60*h* and 60*i*. Thus, the side walls 62 reinforced by the horizontal plates 65 are formed. As is appreciated from FIG. 17B, parts 60*j* between folding lines 60*e* and 60*f* (above the horizontal plates 65) project outward, and parts 60*k* between folding lines 60*g* and 60*h* (below the horizontal plates 65) project inward. Parts 60k are bonded to outer faces of the parts between folding lines 60*a* and 60*d* with glue or the like, and parts 60*j* are bonded to inner faces of the parts outside folding line 60*i* with glue or the like.

In this manner, the housing 60 is completed in the state where the bottom plate 61 is slightly elevated. The housing 60 formed in this manner can accommodate a plurality of cases 50 without using a master carton.

Holder

Figure 18:
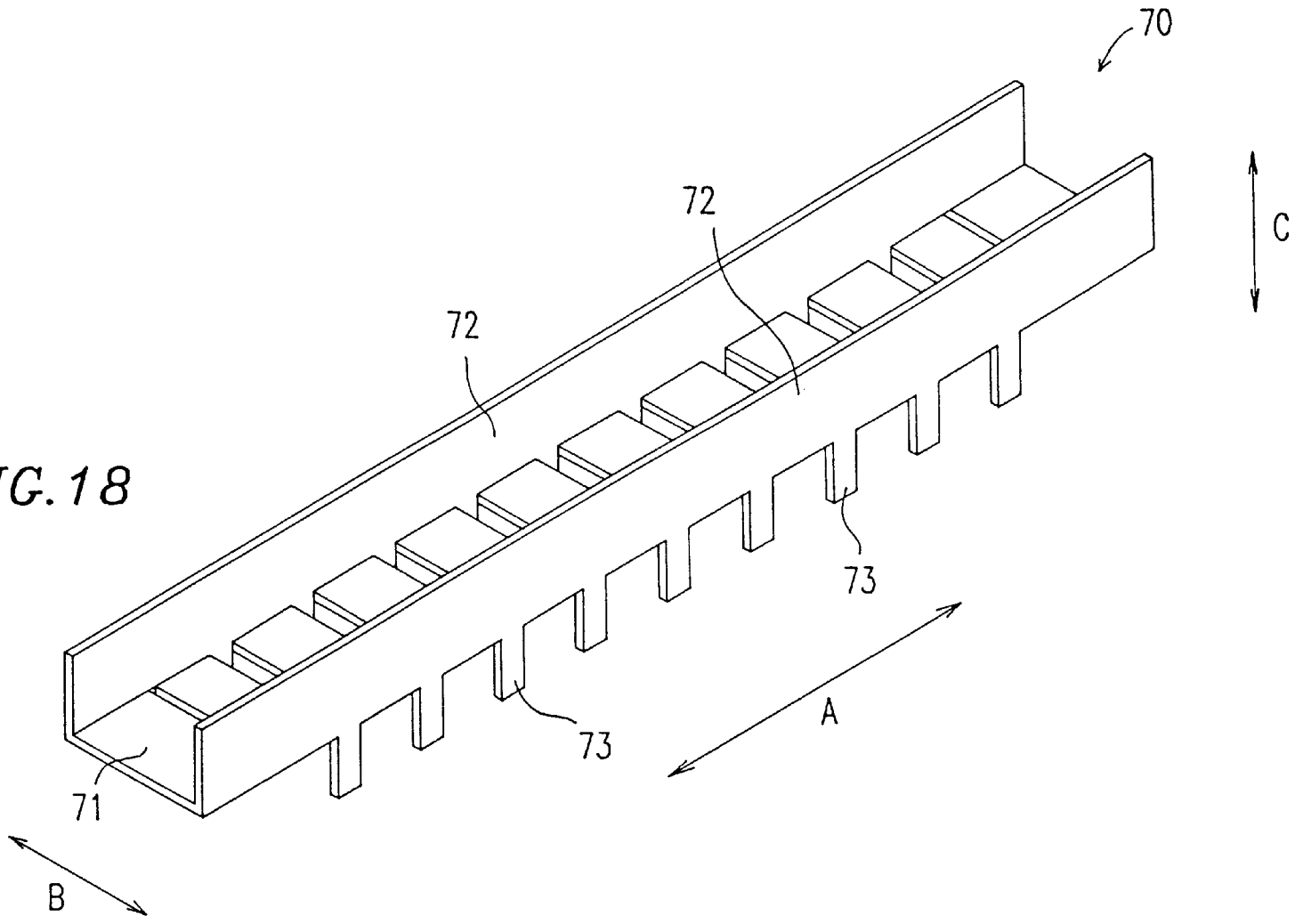
FIG. 18 is an isometric view of a holder in the second example to be mounted on a plurality of cases accommodated in the housing.

FIG. 18 is an isometric view of the holder 70. As is shown in FIG. 18, the holder 70 is formed of a single sheet of cardboard and includes a bottom plate 71 and two side walls 72 extending in the third direction. Along two sides of the bottom plate 71 in direction A, tongues 73 extend in the direction opposite to the direction of the side walls 72. The tongues 73 are provided at a prescribed interval and at corresponding positions along the two sides.

As is shown in FIG. 11, two such holders 70 are engaged with the first steps 58 of the recesses 53 of the plurality of cases 50 arranged in the housing 60 in direction A. In this state, the tongues 73 are inserted between the cases 50.

Figure 19A:
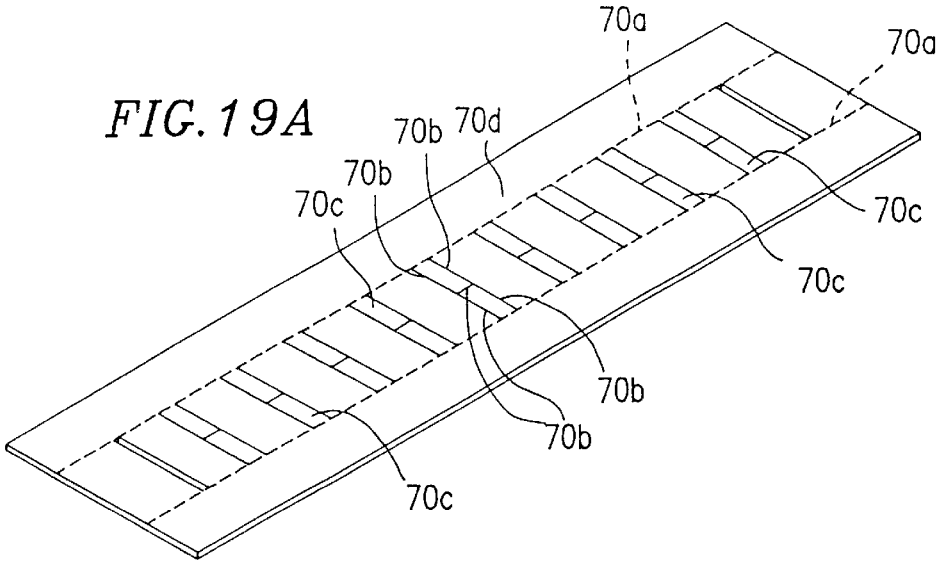
FIGS. 19A and 19B are developed views of the holder.
Figure 19B:
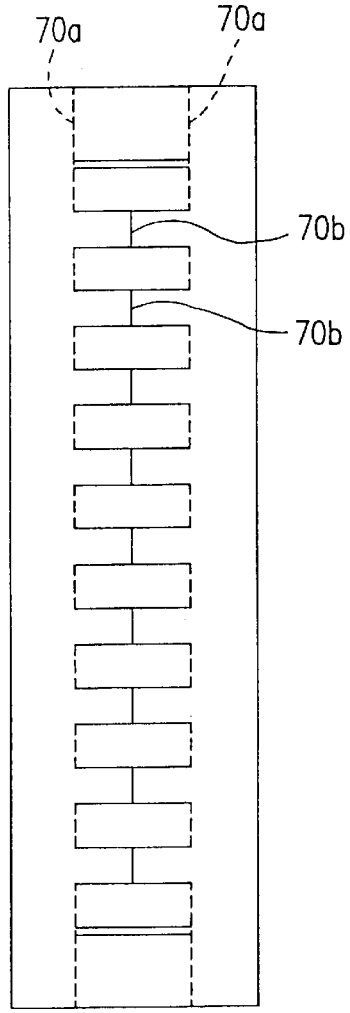

FIGS. 19A and 19B are developed views of the holder 70. The cardboard is rectangular with two longer sides extending in the direction corresponding to direction A and two shorter sides extending in the direction corresponding to direction B. The cardboard has folding lines 70*a* extending in the direction corresponding to direction A.

The cardboard is formed into the holder 70 in the following manner.

First, the cardboard is cut along lines 70*b*. Then, the cardboard is folded along folding lines 70*a* so that parts 70*d* and parts 70*c* point in opposite directions, thereby forming the side walls 72 and the tongues 73. Thus, the holder 70 shown in FIG. 18 is formed.

Partition

Figure 20:
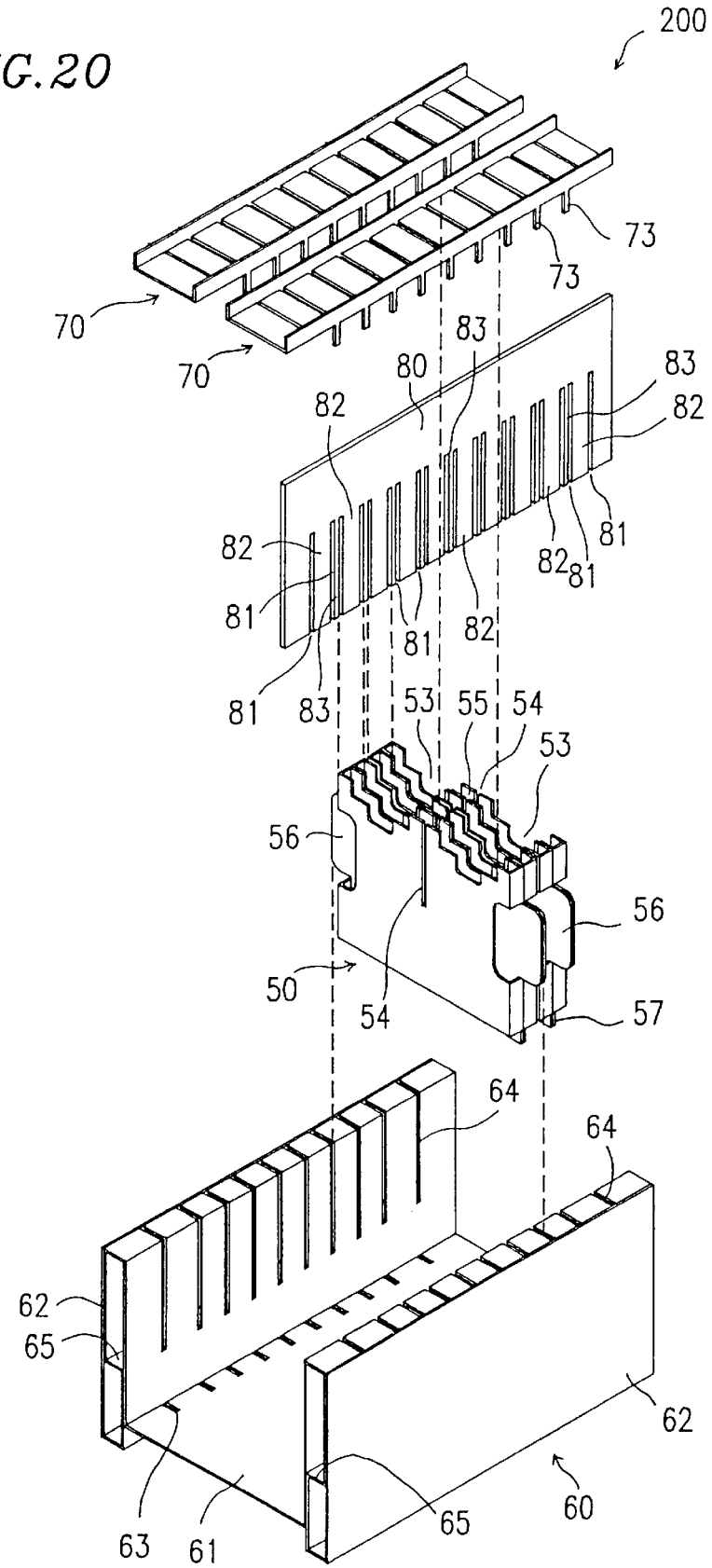
FIG. 20 is an exploded isometric view of the container shown in FIG. 11.

FIG. 20 is an exploded isometric view of the container 200. The partition 80 is formed of a cardboard and has a plurality of pairs of slits 81 formed at prescribed intervals. Each pair of slits 81 correspond to the slits 54 of each case 50.

The partition 80 is fit into the cases 50 by putting each pair of slits 81 into engagement with the slits 54 of the corresponding cases 50 and inserting a part 82 between each pair of slits 81 into the slit 55 of corresponding case 50. A part 83 between two parts 82 is inserted between adjacent cases 50.

Assembly of the Elements

The cases 50 each accommodating four sealed bags 2, each of which vacuum-packs a liquid crystal panel 1, the housing 60, the holders 70, and the partition 80 are assembled into the container 200 shown in FIG. 11 in the following manner.

As is shown in FIG. 20, each case 50 is fit into the housing 60 by inserting the tabs 56 into the grooves 64 and inserting the projections 57 into the slits 63.

After a prescribed number of cases 50 are fit into the housing 60, two holders 70 are fit in the first steps 58 of the recesses 53. By this operation, the tongues 73 are inserted between the cases 50.

Then, the partition 80 is inserted into the cases 50 as is described above. In this manner, the two accommodation spaces of each case 50 defined by the outer walls 51 and the inner walls 52 are further separated into two by part 82 inserted into the slit 55. Thus, the container 200 shown in FIG. 11 is completed.

In the second example, since a plurality of sealed bags 2 each vacuum-packing a liquid crystal panel 1 are arranged in two lines in one housing 60, the size of the container 200 in direction B is smaller than a structure including two housings. Furthermore, since the housing 60 is formed so as to eliminate a master carton, the number of elements is smaller and the amount of cardboard is reduced.

The plurality of cases 50 are reliably secured in direction A by (a) the engagement of the tabs 56 into the slits 64, (b) the engagement of the projections 57 into the slits 63, (c) the insertion of parts 82 of the partition 80 between the outer walls 51 of each case 50, (d) insertion of parts 83 of the partition 80 between adjacent cases 50, and (e) the insertion of the tongues 73 between adjacent cases 50.

The plurality of cases 50 are reliably secured also in direction C by the combination of the engagement of the projections 57 into the slits 63 and the holders 70 fit into the recesses 53.

The liquid crystal panels 1 accommodated in the container 200 are reliably protected against external vibration and impact applied from any direction by the accommodation spaces separated into two by the partition 80 and the side walls 62 of the housing 60 which are each a rectangular pillar reinforced by the horizontal plate 65.

Moreover, the recesses 53 have the two steps 58 and 59. Accordingly, even though the first step 58 is engaged with the holder 70, the openings la of the liquid crystal panel is free from any external force. In addition, since the sealed bag 2 is exposed above the second step 59, the sealed bag 2 can be pulled off from the case 50 without pulling off the case 50. The recesses can be formed to have three or more steps as well as two.

Each case accommodates four sealed bags in the second example, but can accommodate three or less sealed bags with no adverse effect since the case maintains the shape due to the restoring force caused by the appropriate elasticity of the cardboard as well as by the folded structure of the case.

Needless to say, the container in the second example can accommodate any types of electronic devices as well as liquid crystal panels.

As is described above, the case in the second example can accommodate four electronic devices, thus improving cost performance.

The container in the second example includes only one housing, thus saving space. Such a container can be assembled in a shorter period of time and thus more efficiently than a container including two housings. The number of required elements is smaller, and the amount of cardboard can be reduced, thus reducing production cost.

Despite the smaller size, the resistance against external vibration and impact is maintained at the same level as a container with two housings.

The size of the parts of each case which are to be in contact with the sealed bag is determined based on the size of the sealed bag. The size can be relatively easily changed by adjusting the positions and lengths of folding lines and the lines to be cut.

As in the container in the first example, paper need not be recovered for special disposal, thus furthering the cost saving associated with using paper. The cardboard is sufficiently light and still sufficiently resistant against vibration and impact. Moreover, the paper can be recycled and thus favorable from the point of environment conservation.

The container according to the present invention can be formed of any other types of paper which is sufficiently light and has a prescribed strength.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A combination of at least two sealed bags each for vacuum packaging an electronic device and a container therefor, the sealed bags each being evacuated and partially thermally fused at an opening thereof, and each bag comprising:

a first anti-static layer;

a thin metal layer;

an insulative layer; and a second anti-static layer on the exterior of the bag, the container comprising:

a case for accommodating the at least two sealed bags, the case being provided with a charge protective layer on an inner surface thereof;

a housing for accommodating at least two cases; and a master carton for accommodating at least one housing.

2. A combination according to claim 1, wherein the case is formed of cardboard and has at least one tab for fitting the case to the housing.

3. A combination according to claim 2, wherein the housing is also formed of cardboard and has a groove for receiving the at least one tab of the case thus fitting the case to the housing.

4. A combination according to claim 2, wherein the case is supported by the tab inserted into the groove, and wherein (i) an inner area of the case in contact with the at least two sealed bags and (ii) the tab being sized based on the size of each sealed bag.

5. A combination according to claim 1, wherein the master carton is provided with a charge protective layer on an inner surface thereof for direct electrical connection with the second anti-static layer of at least one of the sealed bags.

6. A combination according to claim 1, wherein the master carton is provided with a charge protective layer on an inner surface thereof for indirect electrical connection with the second exterior anti-static layer of at least one sealed bag.

7. A container, comprising:

a case formed of a sheet of paper material, which case has accommodating recesses for accommodating a plurality of electronic devices;

a housing for accommodating a plurality of cases arranged in a first direction, the housing being formed of a sheet of paper material; and a holder fitting in the recesses of the case, the recesses being formed of cutouts of each case, the holder being formed of a sheet of paper material, wherein each case has two accommodation spaces aligned in the first direction, and also has two adjacent recesses aligned in a second direction perpendicular to the first direction, each recess extending in the first direction, and wherein a holder fits into a respective recess.

8. A container according to claim 7, further comprising slits of the case formed in a third direction perpendicular to both of the first and the second directions and a partition formed of a sheet of paper material and fitting into the slits, the partition separating each of the two accommodation spaces of each case into two to define two accommodation spaces arranged in the second direction.

9. A container according to claim 8, wherein each case has a tab on each side of two side surfaces thereof, and the housing has a plurality of grooves extending in the third direction for receiving the tabs of the cases, and the cases are fit into the housing by the engagement of the tabs into the grooves.

10. A container according to claim 7, wherein the two recesses each have two symmetrical first steps and a second step flanked by the first steps below the first steps, and each holder fits into the first steps of the corresponding recess.

11. A container according to claim 10, wherein each holder has a bottom plate and a plurality of tongues arranges in the first direction and projecting from the bottom plate in the third direction, and the tongues are inserted between the plurality of cases arranged in the first direction when the holder fits in the corresponding recess.

12. A container according to claim 7, wherein the cases, the housing, the holder, and the partition are each formed of cardboard.

13. A container according to claim 7, wherein the cases are each provided with a charge protective layer on an inner surface thereof.

* * * * *